US011854400B2

(12) United States Patent
Stenneth et al.

(10) Patent No.: US 11,854,400 B2
(45) Date of Patent: Dec. 26, 2023

(54) APPARATUS AND METHODS FOR PREDICTING EVENTS IN WHICH DRIVERS FAIL TO SEE CURBS

(71) Applicant: HERE GLOBAL B.V., Eindhoven (NL)

(72) Inventors: Leon Stenneth, Chicago, IL (US); Jerome Beaurepaire, Nantes (FR); Jeremy Michael Young, Chicago, IL (US)

(73) Assignee: HERE GLOBAL B.V., Eindhoven (NL)

( * ) Notice: Subject to any disclaimer, the term of this patent is extended or adjusted under 35 U.S.C. 154(b) by 58 days.

(21) Appl. No.: 17/735,922

(22) Filed: May 3, 2022

(65) Prior Publication Data

US 2023/0360532 A1 Nov. 9, 2023

(51) Int. Cl.
*G08G 1/16* (2006.01)

(52) U.S. Cl.
CPC ..... *G08G 1/165* (2013.01)

(58) Field of Classification Search
None
See application file for complete search history.

(56) References Cited

U.S. PATENT DOCUMENTS 8,255,144 B2 * 8/2012 Breed ..... G08G 1/167 340/436
10,093,247 B2 * 10/2018 Zhang ..... B60R 11/04
2006/0074546 A1 * 4/2006 DeKock ..... G08G 1/04 701/532
2015/0078624 A1 * 3/2015 Fukuda ..... G08G 1/168 382/104
2017/0253182 A1 * 9/2017 Aoki ..... G01C 21/265
2018/0144201 A1 * 5/2018 Yoshihira ..... B60R 21/00
(Continued)

OTHER PUBLICATIONS

Yu, et al., Mono-Vision Based Lateral Localization System of Low-Cost Autonomous Vehicles Using Deep Learning Curb Detection, School of Automotive Studies, Tongji University, Shanghai 200092, China; Actuators 2021, 10, 57. https://doi.org/10.3390/act10030057 (13 pgs.).

(Continued)

*Primary Examiner* — Muhammad Adnan
(74) *Attorney, Agent, or Firm* — Peter H. Yu; HERE GLOBAL B.V.

(57) ABSTRACT

An apparatus, method and computer program product are provided for predicting events in which drivers fail to see curbs while the drivers are maneuvering vehicles. In one example, the apparatus receives vehicle attribute data associated with a first vehicle, map data indicating one or more attributes of a road portion including a first curb, and sensor data indicating an orientation of a first driver within the first vehicle. The apparatus causes a machine learning model to render an output as a function of the vehicle attribute data, the map data, and the sensor data. The output indicates a likelihood of which the first driver will not be able to see the first curb at the road portion when the first driver is maneuvering the first vehicle. The machine learning model is trained to predict the output based on historical data indicating events in which second drivers maneuvered second vehicles to encounter the first curb or one or more second curbs.

20 Claims, 11 Drawing Sheets

(56) References Cited

U.S. PATENT DOCUMENTS

| | | | | |
|---|---|---|---|---|
| 2019/0265703 | A1* | 8/2019 | Hicok | G05D 1/0088 |
| 2019/0317505 | A1* | 10/2019 | Li | G01C 21/3407 |
| 2020/0202167 | A1* | 6/2020 | Gross | G06V 10/87 |
| 2021/0094539 | A1* | 4/2021 | Beller | G05D 1/0221 |
| 2021/0241624 | A1* | 8/2021 | Kan | G07C 5/085 |
| 2023/0004744 | A1* | 1/2023 | Pfeiffer | G01S 17/10 |
| 2023/0211787 | A1* | 7/2023 | Hanson | G08G 1/166 701/117 |

OTHER PUBLICATIONS

Panev, et al., "Road Curb Detection and Localization with Monocular Forward-view Vehicle Camera," Carnegie Mellon University, arXiv:2002.12492v1 [cs.CV] Feb. 28, 2020 (17 pgs.).

* cited by examiner

APPARATUS AND METHODS FOR PREDICTING EVENTS IN WHICH DRIVERS FAIL TO SEE CURBS

TECHNICAL FIELD

The present disclosure generally relates to the field of curb detection, associated methods and apparatus, and in particular, concerns, for example, an apparatus configured to predict events in which drivers fail to see curbs while maneuvering vehicles based on attributes of the vehicle, map data, and sensor data acquired by one or more sensors of the vehicle.

BACKGROUND

Vehicles are equipped with navigation systems for assisting drivers for navigating desired routes. While such navigation systems provide useful information such as traffic density data, point of interests (POIs) associated with the desired routes, vehicle accident data, etc., the systems neither detail specific attributes associated with road objects within a given road segment nor provide useful predictions regarding adverse impacts induced from encounters between the vehicles and the road objects.

The listing or discussion of a prior-published document or any background in this specification should not necessarily be taken as an acknowledgement that the document or background is part of the state of the art or is common general knowledge.

BRIEF SUMMARY

According to a first aspect, an apparatus comprising at least one processor and at least one non-transitory memory including computer program code instructions is described. The computer program code instructions, when executed, cause the apparatus to: receive historical data indicating events in which drivers maneuvered vehicles to contact curbs, the historical data indicating vehicle attributes associated with the vehicles, map data indicating attributes of road portions including the curbs, and sensor data indicating orientations of drivers within the vehicles; and based on the historical data, train a machine learning model to predict a likelihood in which a target driver will not be able to see a target curb at a target road portion when the target driver is maneuvering a target vehicle.

According to a second aspect, a non-transitory computer-readable storage medium having computer program code instructions stored therein is described. The computer program code instructions, when executed by at least one processor, cause the at least one processor to: receive vehicle attribute data associated with a first vehicle, map data indicating one or more attributes of a road portion including a first curb, and sensor data indicating an orientation of a first driver within the first vehicle; and cause a machine learning model to render an output as a function of the vehicle attribute data, the map data, and the sensor data, wherein the output indicates a likelihood of which the first driver will not be able to see the first curb at the road portion when the first driver is maneuvering the first vehicle, and wherein the machine learning model is trained to predict the output based on historical data indicating events in which second drivers maneuvered second vehicles to contact the first curb or one or more second curbs.

According to a third aspect, a method of providing a map layer is described. The method includes: receiving vehicle attribute data associated with a first vehicle, map data indicating one or more attributes of a road portion including a first curb, and sensor data indicating an orientation of a first driver within the first vehicle; causing a machine learning model to render a datapoint as a function of the vehicle attribute data, the map data, and the sensor data, wherein the datapoint indicates a likelihood of which the first driver will not be able to see the first curb when the first driver is maneuvering the first vehicle, and wherein the machine learning model is trained to predict the output based on historical data indicating events in which second drivers maneuvered second vehicles to contact the first curb or one or more second curbs; and updating the map layer to include the datapoint at the road portion.

Also, a computer program product may be provided. For example, a computer program product comprising instructions which, when the program is executed by a computer, cause the computer to carry out the steps described herein.

Still other aspects, features, and advantages of the invention are readily apparent from the following detailed description, simply by illustrating a number of particular embodiments and implementations, including the best mode contemplated for carrying out the invention. The invention is also capable of other and different embodiments, and its several details can be modified in various obvious respects, all without departing from the spirit and scope of the invention. Accordingly, the drawings and description are to be regarded as illustrative in nature, and not as restrictive.

The steps of any method disclosed herein do not have to be performed in the exact order disclosed, unless explicitly stated or understood by the skilled person.

Corresponding computer programs (which may or may not be recorded on a carrier) for implementing one or more of the methods disclosed herein are also within the present disclosure and encompassed by one or more of the described example embodiments.

The present disclosure includes one or more corresponding aspects, example embodiments or features in isolation or in various combinations whether or not specifically stated (including claimed) in that combination or in isolation. Corresponding means for performing one or more of the discussed functions are also within the present disclosure.

BRIEF DESCRIPTION OF THE DRAWINGS

The embodiments of the invention are illustrated by way of example, and not by way of limitation, in the figures of the accompanying drawings.

DETAILED DESCRIPTION

Modern vehicles include GPS navigation systems for providing useful information to drivers such as traffic density data, point of interests (POIs) associated with the desired routes, vehicle accident data, etc. However, the details of such information are limited, and such systems are not capable of providing useful predictions regarding adverse impacts induced from encounters between the vehicles and certain road objects. For example, vehicles may frequently collide with curbs of at intersections since: (1) the curbs are positioned within the peripherals of the vehicles and drivers cannot easily see objects within the peripherals; (2) the drivers are unfamiliar with respect to the vehicles' dimensions; or (3) the drivers focus attention thereof on objects/events other than the curbs (e.g., a driver focuses on an incoming traffic when the driver is attempting to make a right turn at an intersection). As such, while GPS navigation systems provide navigational information advising drivers to make certain maneuvers at certain portions of a route, such systems do not assess contextual information associated with the drivers, vehicles associated with the drivers, and attributes associated with environments of said portions and provide predictions indicating potential adverse events associated with said portions based on the contextual information. There will now be described an apparatus and associated methods that may address these issues.

Figure 1:
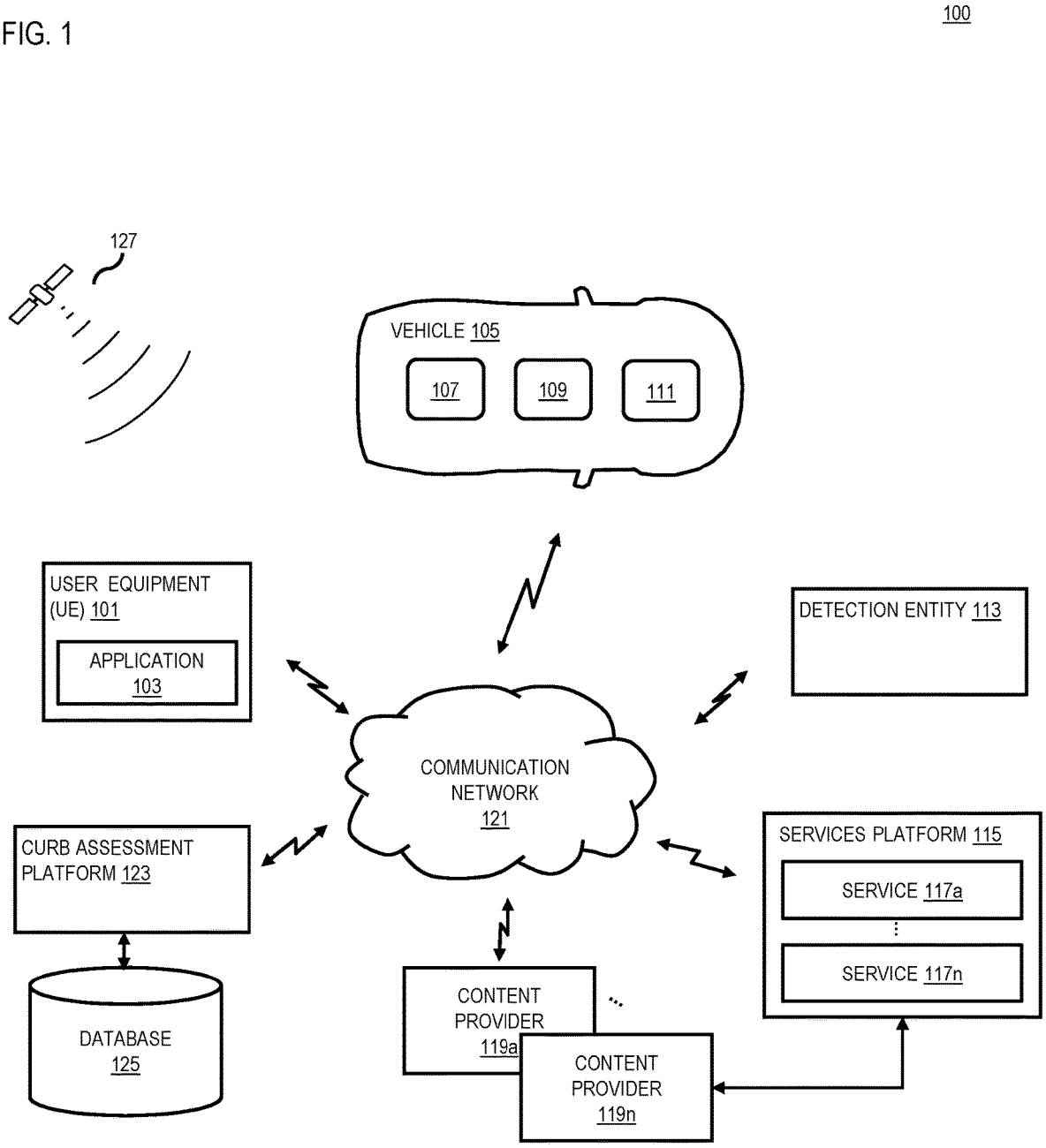
FIG. 1 illustrates a system capable of predicting events in which drivers fail to see curbs while the drivers are maneuvering vehicles, according to one embodiment.

FIG. 1 is a diagram of a system 100 capable of predicting events in which drivers fail to see curbs while the drivers are maneuvering vehicles, according to one embodiment. The system includes a user equipment (UE) 101, a vehicle 105, a detection entity 113, a services platform 115, content providers 119*a*-119*n*, a communication network 121, a curb assessment platform 123, a database 125, and a satellite 127. Additional or a plurality of mentioned components may be provided.

In the illustrated embodiment, the system 100 comprises a user equipment (UE) 101 that may include or be associated with an application 103. In one embodiment, the UE 101 has connectivity to the curb assessment platform 123 via the communication network 121. The curb assessment platform 123 performs one or more functions associated with predicting events in which drivers fail to see curbs while the drivers are maneuvering vehicles. In the illustrated embodiment, the UE 101 may be any type of mobile terminal or fixed terminal such as a mobile handset, station, unit, device, multimedia computer, multimedia tablet, Internet node, communicator, desktop computer, laptop computer, notebook computer, netbook computer, tablet computer, personal communication system (PCS) device, personal digital assistants (PDAs), audio/video player, digital camera/camcorder, positioning device, fitness device, television receiver, radio broadcast receiver, electronic book device, game device, a head-up display (HUD) device of a vehicle, an augment reality HUD device of a vehicle, other devices associated with or integrated with a vehicle (e.g., as part of an infotainment system of the vehicle), or any combination thereof, including the accessories and peripherals of these devices. In one embodiment, the UE 101 can be an in-vehicle navigation system, a personal navigation device (PND), a portable navigation device, a cellular telephone, a mobile phone, a personal digital assistant (PDA), a watch, a camera, a computer, and/or other device that can perform navigation-related functions, such as digital routing and map display. In one embodiment, the UE 101 can be a cellular telephone. A user may use the UE 101 for navigation functions, for example, road link map updates. It should be appreciated that the UE 101 can support any type of interface to the user (such as "wearable" devices, etc.).

In the illustrated embodiment, the application 103 may be any type of application that is executable by the UE 101, such as a location-based service application, a navigation application, a content provisioning service, a camera/imaging application, a media player application, a social networking application, a calendar application, or any combination thereof. In one embodiment, one of the applications 103 at the UE 101 may act as a client for the curb assessment platform 123 and perform one or more functions associated with the functions of the curb assessment platform 123 by interacting with the curb assessment platform 123 over the communication network 121. The application 103 may assist in conveying and/or receiving information regarding one or more locations of curb relative to the vehicle 105. For example, the application 103 may cause the UE 101 to provide a notification indicating a prediction of whether a driver of the vehicle 105 will be able to see a curb and/or a likelihood in which the driver will maneuver the vehicle to hit the curb.

The vehicle 105 may be a standard gasoline powered vehicle, a hybrid vehicle, an electric vehicle, a fuel cell vehicle, and/or any other mobility implement type of vehicle. The vehicle 105 includes parts related to mobility, such as a powertrain with an engine, a transmission, a suspension, a driveshaft, and/or wheels, etc. The vehicle 105 may be a non-autonomous vehicle or an autonomous vehicle. The term autonomous vehicle may refer to a self-driving or driverless mode in which no passengers are required to be on board to operate the vehicle. An autonomous vehicle may be referred to as a robot vehicle or an automated vehicle. The autonomous vehicle may include passengers, but no driver is necessary. These autonomous vehicles may park themselves or move cargo between locations without a human operator. Autonomous vehicles may include multiple modes and transition between the modes. The autonomous vehicle may steer, brake, or accelerate the vehicle based on the position of the vehicle in order, and may respond to lane marking indicators (lane marking type, lane marking intensity, lane marking color, lane marking offset, lane marking width, or other characteristics) and driving commands or navigation commands. In one embodiment, the vehicle 105 may be assigned with an autonomous level. An autonomous level of a vehicle can be a Level 0 autonomous level that corresponds to a negligible automation for the vehicle, a Level 1 autonomous level that corresponds to a certain degree of driver assistance for the vehicle 105, a Level 2 autonomous level that corresponds to partial automation for the vehicle, a Level 3 autonomous level that corresponds to conditional automation for the vehicle, a Level 4 autonomous level that corresponds to high automation for the vehicle, a Level 5 autonomous level that corresponds to full automation for the vehicle, and/or another sub-level associated with a degree of autonomous driving for the vehicle.

In one embodiment, the UE 101 may be integrated in the vehicle 105, which may include assisted driving vehicles such as autonomous vehicles, highly assisted driving (HAD), and advanced driving assistance systems (ADAS). Any of these assisted driving systems may be incorporated into the UE 101. Alternatively, an assisted driving device may be included in the vehicle 105. The assisted driving device may include memory, a processor, and systems to communicate with the UE 101. In one embodiment, the vehicle 105 may be an HAD vehicle or an ADAS vehicle. An HAD vehicle may refer to a vehicle that does not completely replace the human operator. Instead, in a highly assisted driving mode, a vehicle may perform some driving functions and the human operator may perform some driving functions. Such vehicle may also be driven in a manual mode in which the human operator exercises a degree of control over the movement of the vehicle. The vehicle 105 may also include a completely driverless mode. The HAD vehicle may control the vehicle through steering or braking in response to the on the position of the vehicle and may respond to lane marking indicators (lane marking type, lane marking intensity, lane marking color, lane marking offset, lane marking width, or other characteristics) and driving commands or navigation commands. Similarly, ADAS vehicles include one or more partially automated systems in which the vehicle alerts the driver. The features are designed to avoid collisions automatically. Features may include adaptive cruise control, automate braking, or steering adjustments to keep the driver in the correct lane. ADAS vehicles may issue warnings for the driver based on the position of the vehicle or based on the lane marking indicators (lane marking type, lane marking intensity, lane marking color, lane marking offset, lane marking width, or other characteristics) and driving commands or navigation commands.

The vehicle 105 includes sensors 107, an on-board communication platform 109, and an on-board computing platform 111. The sensors 107 may include image sensors (e.g., electronic imaging devices of both analog and digital types, which include digital cameras, camera modules, camera phones, thermal imaging devices, radar, sonar, lidar, etc.). One or more of the image sensors may be installed within a cabin of the vehicle 105 to track orientations of the drivers, head positions, eye directions, etc. One or more of the images sensors may be front a facing camera, a rear facing camera, side view mirror cameras, etc. One or more of the image sensors may be installed on an exterior surface of the vehicle 105 and be oriented to capture images of objects within a peripheral of the vehicle 105. The sensors 107 further includes a network detection sensor for detecting wireless signals or receivers for different short-range communications (e.g., Bluetooth, Wi-Fi, Li-Fi, near field communication (NFC), etc.), temporal information sensors, an audio recorder for gathering audio data, velocity sensors, light sensors, oriental sensors augmented with height sensor and accelerometer, suspension sensor, tilt sensors to detect the degree of incline or decline of the vehicle 105 along a path of travel, etc. In a further embodiment, one or more of the sensors 107 about the perimeter of the vehicle 105 may detect the relative distance of the vehicle 105 from stationary objects (e.g., construct, wall, etc.), road objects, lanes, or roadways, the presence of other vehicles, pedestrians, traffic lights, road features (e.g., curves) and any other objects, or a combination thereof. Such sensors will be referred as proximity sensors, herein. In one embodiment, the vehicle 105 may include GPS receivers to obtain geographic coordinates from satellites 127 for determining current location and time associated with the vehicle 105. Further, the location can be determined by a triangulation system such as A-GPS, Cell of Origin, or other location extrapolation technologies. In one embodiment, the sensors 107 include vehicle seat adjustment sensors that are capable of estimating an orientation of a person sitting on a vehicle seat based on vehicle seat adjustment settings associated with the vehicle seat.

Figure 2:
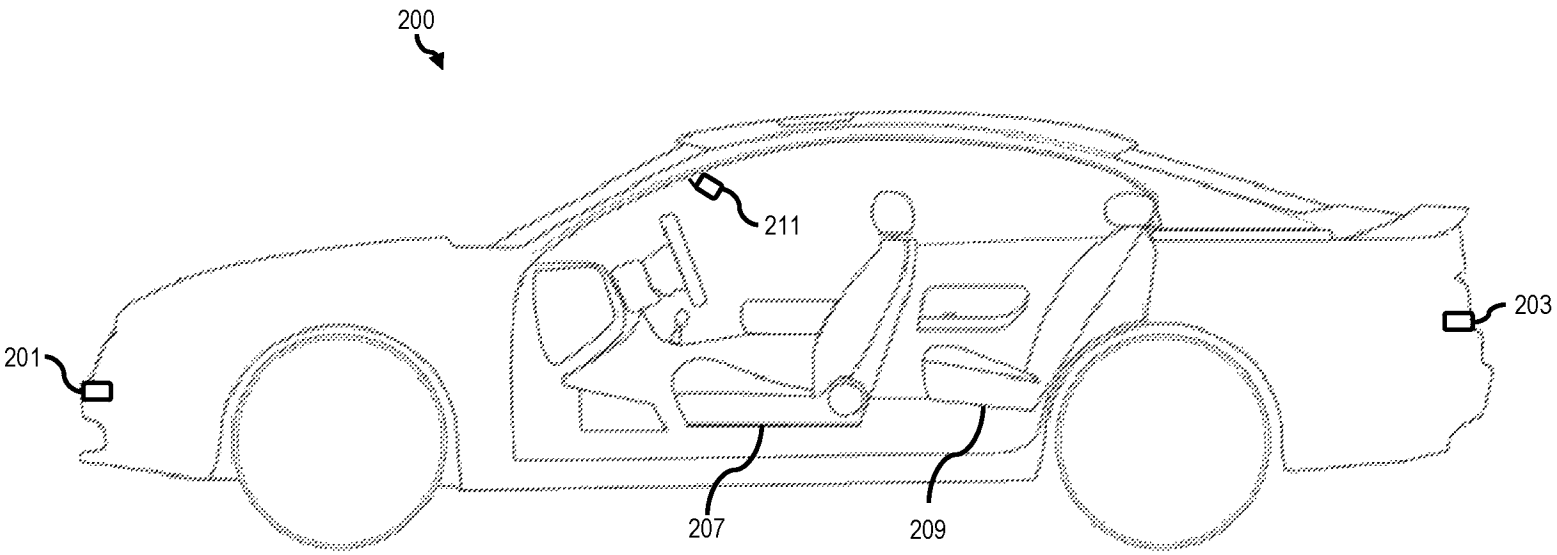
FIG. 2 illustrates a side view of an example vehicle exposing an interior cabin thereof.

FIG. 2 illustrates a side view of an example vehicle exposing an interior cabin of the vehicle. In the illustrated example, a vehicle 200 includes a front view image sensor 201 equipped at a front end of the vehicle 200 and a rear view image sensor 203 equipped at a rear end of the vehicle 200. In the illustrated example, vehicles doors of the vehicle 200 are not illustrated for the purpose of providing visuals of certain components within a cabin 205 of the vehicle 200. The cabin 205 includes vehicle seats 207 and 209 and a driver facing image sensor 211. The vehicle seats 207 and 209 are adjustable by a passenger and are equipped with sensors for indicating vehicle seat adjustment settings associated with the vehicle seats 207 and 209. FIG. 2 exemplifies the vehicle 105 of FIG. 1 and one or more positions and orientations of one or more of the sensors 107 equipped by the vehicle 105.

Returning to FIG. 1, the on-board communications platform 109 includes wired or wireless network interfaces to enable communication with external networks. The on-board communications platform 109 also includes hardware (e.g., processors, memory, storage, antenna, etc.) and software to control the wired or wireless network interfaces. In the illustrated example, the on-board communications platform 109 includes one or more communication controllers (not illustrated) for standards-based networks (e.g., Global System for Mobile Communications (GSM), Universal Mobile Telecommunications System (UMTS), Long Term Evolution (LTE) networks, 5G networks, Code Division Multiple Access (CDMA), WiMAX (IEEE 802.16 m); Near Field Communication (NFC); local area wireless network (including IEEE 802.11 a/b/g/n/ac or others), dedicated short range communication (DSRC), and Wireless Gigabit (IEEE 802.11 ad), etc.). In some examples, the on-board communications platform 109 includes a wired or wireless interface (e.g., an auxiliary port, a Universal Serial Bus (USB) port, a Bluetooth® wireless node, etc.) to communicatively couple with the UE 101.

The on-board computing platform 111 performs one or more functions associated with the vehicle 105. In one embodiment, the on-board computing platform 109 may aggregate sensor data generated by at least one of the sensors 107 and transmit the sensor data via the on-board communications platform 109. The on-board computing platform 109 may receive control signals for performing one or more of the functions from the curb assessment platform 123, the UE 101, the services platform 115, one or more of the content providers 119*a*-121*n*, or a combination thereof via the on-board communication platform 111. The on-board computing platform 111 includes at least one processor or controller and memory (not illustrated). The processor or controller may be any suitable processing device or set of processing devices such as, but not limited to: a microprocessor, a microcontroller-based platform, a suitable integrated circuit, one or more field programmable gate arrays (FPGAs), and/or one or more application-specific integrated circuits (ASICs). The memory may be volatile memory (e.g., RAM, which can include non-volatile RAM, magnetic RAM, ferroelectric RAM, and any other suitable forms); non-volatile memory (e.g., disk memory, FLASH memory, EPROMs, EEPROMs, non-volatile solid-state memory, etc.), unalterable memory (e.g., EPROMs), read-only memory, and/or high-capacity storage devices (e.g., hard drives, solid state drives, etc.). In some examples, the memory includes multiple kinds of memory, particularly volatile memory and non-volatile memory.

The detection entity 113 may be another vehicle, a drone, a user equipment, a road-side sensor, or a device mounted on a stationary object within or proximate to a road segment (e.g., a traffic light post, a sign post, a post, a building, etc.). The detection entity 113 includes one or more image sensors such as electronic imaging devices of both analog and digital types, which include digital cameras, camera modules, camera phones, thermal imaging devices, radar, sonar, lidar, etc.. The detection entity 113 may further include a network detection sensor for detecting wireless signals or receivers for different short-range communications (e.g., Bluetooth, Wi-Fi, Li-Fi, near field communication (NFC), etc.), temporal information sensors, an audio recorder for gathering audio data, velocity sensors, light sensors, oriental sensors augmented with height sensor and acceleration sensor, tilt sensors to detect the degree of incline or decline of the detection entity 113 along a path of travel, etc. In a further embodiment, sensors about the perimeter of the detection entity 113 may detect the relative distance of the detection entity 113 from road objects, lanes, or roadways, the presence of other vehicles, pedestrians, traffic lights, road features (e.g., curves) and any other objects, or a combination thereof. In one embodiment, the detection entity 113 may include GPS receivers to obtain geographic coordinates from satellites 127 for determining current location and time associated with the detection entity 113. Further, the location can be determined by a triangulation system such as A-GPS, Cell of Origin, or other location extrapolation technologies. The detection entity 113 may further include a receiver and a transmitter for maintaining communication with the curb assessment platform 123 and/or other components within the system 100.

The services platform 115 may provide one or more services 117*a*-117*n* (collectively referred to as services 117), such as mapping services, navigation services, travel planning services, weather-based services, emergency-based services, notification services, social networking services, content (e.g., audio, video, images, etc.) provisioning services, application services, storage services, contextual information determination services, location-based services, information-based services, etc. In one embodiment, the services platform 115 may be an original equipment manufacturer (OEM) platform. In one embodiment the one or more service 117 may be sensor data collection services. By way of example, vehicle sensor data provided by the sensors 107 may be transferred to the UE 101, the curb assessment platform 123, the database 125, or other entities communicatively coupled to the communication network 121 through the service platform 115. In one embodiment, the services platform 115 uses the output data generated by of the curb assessment platform 123 to provide services such as navigation, mapping, other location-based services, etc.

In one embodiment, the content providers 119*a*-119*n* (collectively referred to as content providers 119) may provide content or data (e.g., including geographic data, parametric representations of mapped features, etc.) to the UE 101, the vehicle 105, services platform 115, the vehicle 105, the database 125, the curb assessment platform 123, or the combination thereof. In one embodiment, the content provided may be any type of content, such as map content, textual content, audio content, video content, image content, etc. In one embodiment, the content providers 119 may provide content that may aid in predicting events in which drivers fail to see curbs while the drivers are maneuvering vehicles, and/or other related characteristics. In one embodiment, the content providers 119 may also store content associated with the UE 101, the vehicle 105, services platform 115, the curb assessment platform 123, the database 125, or the combination thereof. In another embodiment, the content providers 119 may manage access to a central repository of data, and offer a consistent, standard interface to data, such as a repository of the database 125.

The communication network 121 of system 100 includes one or more networks such as a data network, a wireless network, a telephony network, or any combination thereof. The data network may be any local area network (LAN), metropolitan area network (MAN), wide area network (WAN), a public data network (e.g., the Internet), short range wireless network, or any other suitable packet-switched network, such as a commercially owned, proprietary packet-switched network, e.g., a proprietary cable or fiber-optic network, and the like, or any combination thereof. In addition, the wireless network may be, for example, a cellular network and may employ various technologies including enhanced data rates for global evolution (EDGE), general packet radio service (GPRS), global system for mobile communications (GSM), Internet protocol multimedia subsystem (IMS), universal mobile telecommunications system (UMTS), etc., as well as any other suitable wireless medium, e.g., worldwide interoperability for microwave access (WiMAX), Long Term Evolution (LTE) networks, 5G networks, code division multiple access (CDMA), wideband code division multiple access (WCDMA), wireless fidelity (Wi-Fi), wireless LAN (WLAN), Bluetooth®, Internet Protocol (IP) data casting, satellite, mobile ad-hoc network (MANET), and the like, or any combination thereof.

In the illustrated embodiment, the curb assessment platform 123 may be a platform with multiple interconnected components. The curb assessment platform 123 may include multiple servers, intelligent networking devices, computing devices, components and corresponding software for predicting events in which drivers fail to see curbs while the drivers are maneuvering vehicles. It should be appreciated that that the curb assessment platform 123 may be a separate entity of the system 100, included within the UE 101 (e.g., as part of the applications 103), included within the vehicle 105 (e.g., as part of an application stored in the memory of the on-board computing platform 111), included within the services platform 115 (e.g., as part of an application stored in server memory for the services platform 115), included within the content providers 119 (e.g., as part of an application stored in sever memory for the content providers 119), other platforms embodying a power supplier (not illustrated), or a combination thereof.

The curb assessment platform 123 is capable of acquiring vehicle attribute data associated with the vehicle 105, map data indicating attributes of an environment in which a curb is located, and sensor data acquired by the vehicle 105 and using the data to render a prediction of whether the driver will not see the curb. The curb assessment platform 123 may acquire the data from the vehicle 105, the services platform 115, the content providers 119, and/or the database 125.

The vehicle attribute data indicate specifications of the vehicle 105 such as: (1) a vehicle type; (2) a vehicle height; (3) a wheel width; (4) a wheel height; (5) a vehicle seat height; (6) a thickness between a floor surface of a vehicle cabin and an exterior vehicle surface opposing the floor surface; (7) a distance from a front end of the vehicle 105 to a driver seat; (8) dimensions of a front windshield of the vehicle 105; (9) a position/orientation of a front windshield relative to the vehicle 105; (10) dimensions of a hood of the vehicle 105; (11) a position/orientation of the hood; (12) dimensions of various portions of a vehicle; (13) one or more ranges of motion for a vehicle seat; or (14) a combination thereof.

The map data indicate attributes of an environment in which a curb is located such as: (1) one or more road curvatures of a road segment or node in which the curb is located; (2) one or more turn restrictions of the road segment or node; (3) a number of lanes within the road segment or node; (4) one or more lane directions for the road segment or node; (5) a functional class for the road segment or node; (6) a speed limit for the road segment or node; (7) one or more physical dividers within the road segment or node; (8) dimensions of the curb; (9) a curvature of the curb; (10) a relative position of the curb with respect to one or more road objects within the road segment or node (e.g., lane markings, a physical divider, another curb, a traffic light post, etc.); or (11) a combination thereof.

The sensor data may indicate readings acquired by one or more of the sensors 107 of the vehicle 105 during a period in which the vehicle 105 is approaching a location of the curb. For example, the sensor data may indicate: (1) a relative position of the vehicle 105 within a portion of a road including the curb; (2) a current speed of the vehicle 105; (3) a heading of the vehicle 105; or (4) a combination thereof. The sensor data may also indicate attributes of a driver of the vehicle 105 and/or driving patterns of the driver. Specifically, the sensor data may include past sensor data indicating one or more paths of travel for traversing one or more road segments or nodes including one or more other curbs and one or more speed levels for traversing said paths of travel. The past sensor data may also indicate driver behaviors and mannerisms associated with the driver of the vehicle 105 when the vehicle 105 approaches a type of road segment or node. For example, the past sensor data may indicate that the driver typically focuses his/her attention on an incoming traffic of an intersecting road segment when the vehicle 105 approaches an intersection. By way of another example, the past sensor data may also indicate how the driver typically maneuvers the vehicle 105 and positions the vehicle 105 when the vehicle 105 approaches an intersection. The past sensor data indicating the driver behaviors and mannerisms may be defined, at least in part by: (1) one or more head positions/orientations of the driver of the vehicle 105; (2) one or more eye directions of the driver; (3) one or more steering wheel angles; or (4) a combination thereof.

In one embodiment, the sensor data are captured by one or more image sensors of the vehicle 105 that faces an external environment of the vehicle 105 and one or more images sensors of the vehicle 105 that faces the interior of the vehicle 105. In one embodiment, the sensor data may indicate vehicle seat adjustment settings associated with one or more vehicle seats within the vehicle 105. In such embodiment, the curb assessment platform 123 uses the vehicle seat adjustment settings to estimate an orientation of a person sitting on one of the vehicle seats. In one embodiment, certain datapoints of the sensor data are acquired by one or more detection entities 113 that is proximate to the location of the curb during the period in which the vehicle 105 is approaching a location of the curb. For example, a detection entity 113, such as a traffic camera, may observe a position of the vehicle 105 relative to the location of the curb and transmit image data indicating the relative position to the curb assessment platform 123.

The data acquired by the curb assessment platform 123 is input to a machine learning model, and in response, the machine learning model outputs a prediction of whether a driver will not see a curb. The curb assessment platform 123 embodies the machine learning model and trains the machine learning model to output the prediction by using historical data as a training dataset. The historical data indicate events in which drivers have maneuvered vehicles to contact curbs. The historical data indicate, for each vehicle that is indicated as a part of the training dataset, vehicle attribute data associated with said vehicle, attributes of one or more environments in which one or more of the curbs is located, and sensor data acquired by said vehicle. Such data associated with vehicles that are used as the training dataset correspond to variables of vehicle attribute data, map data, and sensor data as provided as input for the machine learning model. As such, details thereof will not be described herein for brevity. In one embodiment, data associated with drivers and vehicles as indicated in the training dataset do not exclude data associated with a driver of the vehicle 105 and the vehicle 105 (e.g., the past sensor data associated with the vehicle 105). As such, the data associated with said driver and the vehicle 105 may be used as the training dataset to train the machine learning model and used to render a prediction of whether a driver will not see a curb.

In one embodiment, the sensor data associated with each vehicle that is indicated as a part of the training dataset not only indicate data acquired from one or more sensors of said vehicle during a first period in which said vehicle approaches a curb, but the sensor data further indicate data acquired from said sensors during a second subsequent period in which said vehicle encounters the curb and continues the travel thereof. By way of example, a portion of the sensor data acquired during the second period indicate that the vehicle has contacted a curb. In such example, the portion of the sensor data may be readings from an accelerometer of the vehicle indicating that the vehicle has contacted the curb. By way of another example, a portion of the sensor data acquired during the second period may indicate a type of impact rendered on the vehicle as a result of the vehicle contacting the curb. For example, vehicle suspension sensors of the vehicle may indicate that a suspension of the vehicle is damaged subsequent to the vehicle contacting the curb.

Once the machine learning model is trained, the machine learning model analyses the data input thereto and correlates one or more datapoints of the data to the training dataset. For example, the machine learning model may receive input data indicating that a driver of the vehicle 105 is approaching an intersection including a curb and is attempting to make a turn at a portion of the intersection including the curb. In such example, the machine learning model refers to the training dataset to identify: (1) one or more events in which one or more vehicles have approached the intersection, turned at said portion, and contacted the curb; (2) one or more events in which one or more vehicles have approached one or more intersections having similar attributes as the intersection, turned at one or more portions of said intersections including one or more curbs, and contacted said curbs; or (3) a combination thereof. By way of another example, the machine learning model may receive input data indicating that: (1) the vehicle 105 is a truck having a first wheel height; and (2) a driver of the vehicle 105 is approaching an intersection including a curb and is attempting to make a turn at a portion of the intersection including the curb. In such example, the machine learning model refers to the training dataset to identify one or more events in which: (1) one or more vehicles is a truck having the first wheel height; and (2) said vehicles have approached the intersection, turned at said portion, and contacted the curb. By way of another example, the machine learning model may receive input data indicating that a driver of the vehicle 105 having first seat adjustment settings is approaching an intersection including a curb and is attempting to make a turn at a portion of the intersection including the curb. In such example, the machine learning model refers to the training dataset to identify one or more events in which one or more drivers having the first seat adjustment settings have maneuvered one or more vehicles to approach one or more other intersections, turn at one or more portions of the one or more other intersections, and contact one or more curbs at the one or more portions. By way of another example, the machine learning model may receive an input data indicating that: (1) a driver of the vehicle 105 is approaching an intersection including a curb and is attempting to make a turn at a portion of the intersection including the curb; and (2) the driver has a pattern of behavior in which the driver focuses his/her attention towards an incoming traffic of an intersecting road segment. In such example, the machine learning model refers to the training dataset to identify one or more events in which: (1) one or more vehicles have approached one or more other intersections, turned at one or more portions of said one or more other intersections, and contacted one or more curbs at the one or more portions; and (2) one or more drivers of said vehicles have the same or similar pattern of behavior as the driver of the vehicle 105. Based on a number of identified events and a degree at which each identified event corresponds to the input data, the machine learning model outputs a likelihood in which the vehicle 105 will contact the curb.

In one embodiment, the curb assessment platform 123 platform automatically causes the machine learning model to predict whether the vehicle 105 will hit a curb when the curb assessment platform 123 detects that the vehicle 105 satisfies one or more conditions. For example, the curb assessment platform 123 causes the machine learning model to render the prediction when the vehicle 105 approaches an intersection. By way of another example, the curb assessment platform 123 causes the machine learning model to render the prediction when a steering angle of the vehicle 105 exceeds a threshold angle (e.g., more than 35 degrees). In one embodiment, the curb assessment platform 123 periodically causes the machine learning model to predict whether the vehicle 105 will hit a curb. In such embodiment, the curb assessment platform 123 renders the prediction on a curb closest to the vehicle 105 or an upcoming curb within a given route of the vehicle 105.

When the curb assessment platform 123 predicts that the vehicle 105 will hit a curb, the curb assessment platform 123 generates a visual notification and/or an audible notification to be output at the UE 101 and/or the vehicle 105 (e.g., an infotainment system of the vehicle 105), thereby informing a driver of the vehicle 105 regarding an existence of the curb. In one embodiment, to indicate the position of the curb relative to the vehicle 105, the curb assessment platform 123 generates a visual representation of the vehicle 105 and a peripheral thereof including the curb that represents the position of the vehicle 105 relative to the curb in real-time. In one embodiment, to indicate the position of the curb relative to the vehicle 105, the curb assessment platform 123 identifies a location of the curb and eye directions of the driver and provides an augmented reality display via an HUD of the vehicle 105. The augmented reality display may emphasize the location of the curb from the driver's point of view, thereby informing the driver of the vehicle 105 regarding the location of the curb. In one embodiment, to indicate the position of the curb relative to the vehicle 105, the curb assessment platform 123 causes one of a plurality of speakers closest to the position of the curb to output an audio signal at a first volume while causing the remaining number of speakers to output the audio signal at a second lower volume. In one embodiment, the curb assessment platform 123 generates a calculated path of travel for the vehicle 105 that avoids contact with the curb. The curb assessment platform 123 generates the calculated path of travel as a function of a current location of the vehicle 105, a current speed of the vehicle 105, and a current heading of the vehicle 105. In one embodiment, the curb assessment platform 123 uses the calculated path of travel to generate audible instructions for the UE 101 and/or the vehicle 105 in assisting a driver of the vehicle 105 to avoid the curb. In one embodiment, when the curb assessment platform 123 predicts that the vehicle 105 will hit the curb, the curb assessment platform 123 determines ideal mirror adjustment settings and/or seat adjustment settings for the driver of the vehicle 105 and provides the ideal settings to the vehicle 105, thereby increasing the visibility of the curb for the driver when the vehicle 105 encounters the curb. For example, the side mirrors of the vehicle 105 may initially be perpendicular with respect to the ground, and the ideal setting for the side mirrors may be slightly tilting the side mirrors such that the side mirrors face the ground at an angle, thereby enabling the driver to observe the peripheral of the vehicle 105 at a closer distance. By way of another example, if a back rest of a driver seat of the vehicle 105 makes a first angle with respect to a base of the driver seat, the ideal setting for the driver seat may be adjusting the driver seat such that the back rest makes a second lesser angle with respect to the base, thereby enabling the driver to have a greater area of vision through one or more windshields of the vehicle 105.

In one embodiment, the curb assessment platform 123 may detect that the vehicle 105 is attached to a trailer and render a prediction of whether the vehicle 105 and/or the trailer will contact a curb. In such embodiment, the curb assessment platform 123 acquires vehicle attribute data associated with the vehicle 105, map data indicating attributes of an environment in which a curb is located, sensor data acquired by the vehicle 105, and trailer attribute data indicating one or more attributes of the trailer such as a model, type, classification, dimensions of the trailer, etc. To render the prediction, the curb assessment platform 123 determines a projected path of travels of the vehicle 105 and the trailer based the vehicle attribute data, trailer attribute data, map data, and sensor data. For example, assuming that the vehicle 105 includes front wheels and rear wheels and that the trailer includes trainer wheels, the curb assessment platform 123 calculates a first projected path of travel for the front wheels of the vehicle 105, a second projected path of travel for the rear wheels of the vehicle 105, and a third projected path of travel for the trainer wheels of the trailer. If the curb assessment platform 123 determines that one or more of the first to third projected path of travels are to interfere with the curb, the curb assessment platform 123 predicts that the vehicle 105 and/or the trailer will contact the curb. In one embodiment, the curb assessment platform 123 determines one or more projected path of travels by inputting vehicle attribute data associated with the vehicle 105, map data indicating attributes of an environment in which a curb is located, sensor data acquired by the vehicle 105, and trailer attribute data associated with a trailer attached to the vehicle 105 to the machine learning model. The machine learning model may correlate one or more aspects of the input data to the training data set to predict said projected driving path. For example, the input data may indicate that the vehicle 105 and the trailer is moving at a first speed at a first heading at an intersection including a curb and is attempting to make a turn at the curb. The machine learning model may identify one or more past events in which the vehicle 105 and the trailer and/or other similar vehicles towing trailers have made a turn at the intersection and/or other similar intersections at the first speed and the first heading or similar to the first speed and the first heading. For each identified past event, the machine learning model determines path of travels of the vehicle and the trailer of said event. Based on the path of travels of the vehicle and the trailer for each identified past event, the machine learning model may output one or more projected path of travels for the vehicle 105 and the trailer. In one embodiment, if the curb assessment platform 123 predicts that the path of travel of the vehicle 105 and/or the trailer will contact the curb, the curb assessment platform 123 causes a visual notification and/or an audible notification to be output at the UE 101 and/or the vehicle 105.

In the illustrated embodiment, the database 125 stores information on road links (e.g., road length, road breadth, slope information, curvature information, geographic attributes, etc.), probe data for one or more road links (e.g., traffic density information), POIs, and other types map-related features. In one embodiment, the database 125 may include any multiple types of information that can provide means for aiding in predicting events in which drivers fail to see curbs while the drivers are maneuvering vehicles. It should be appreciated that the information stored in the database 125 may be acquired from any of the elements within the system 100, other vehicles, sensors, database, or a combination thereof.

In one embodiment, the UE 101, the vehicle 105, the detection entity 113, the services platform 115, the content providers 119, the curb assessment platform 123 communicate with each other and other components of the communication network 121 using well known, new or still developing protocols. In this context, a protocol includes a set of rules defining how the network nodes within the communication network 121 interact with each other based on information sent over the communication links. The protocols are effective at different layers of operation within each node, from generating and receiving physical signals of various types, to selecting a link for transferring those signals, to the format of information indicated by those signals, to identifying which software application executing on a computer system sends or receives the information. The conceptually different layers of protocols for exchanging information over a network are described in the Open Systems Interconnection (OSI) Reference Model.

Communications between the network nodes are typically affected by exchanging discrete packets of data. Each packet typically comprises (1) header information associated with a particular protocol, and (2) payload information that follows the header information and contains information that may be processed independently of that particular protocol. In some protocols, the packet includes (3) trailer information following the payload and indicating the end of the payload information. The header includes information such as the source of the packet, its destination, the length of the payload, and other properties used by the protocol. Often, the data in the payload for the particular protocol includes a header and payload for a different protocol associated with a different, higher layer of the OSI Reference Model. The header for a particular protocol typically indicates a type for the next protocol contained in its payload. The higher layer protocol is said to be encapsulated in the lower layer protocol. The headers included in a packet traversing multiple heterogeneous networks, such as the Internet, typically include a physical (layer 1) header, a data-link (layer 2) header, an internetwork (layer 3) header and a transport (layer 4) header, and various application (layer 5, layer 6 and layer 7) headers as defined by the OSI Reference Model.

Figure 3:
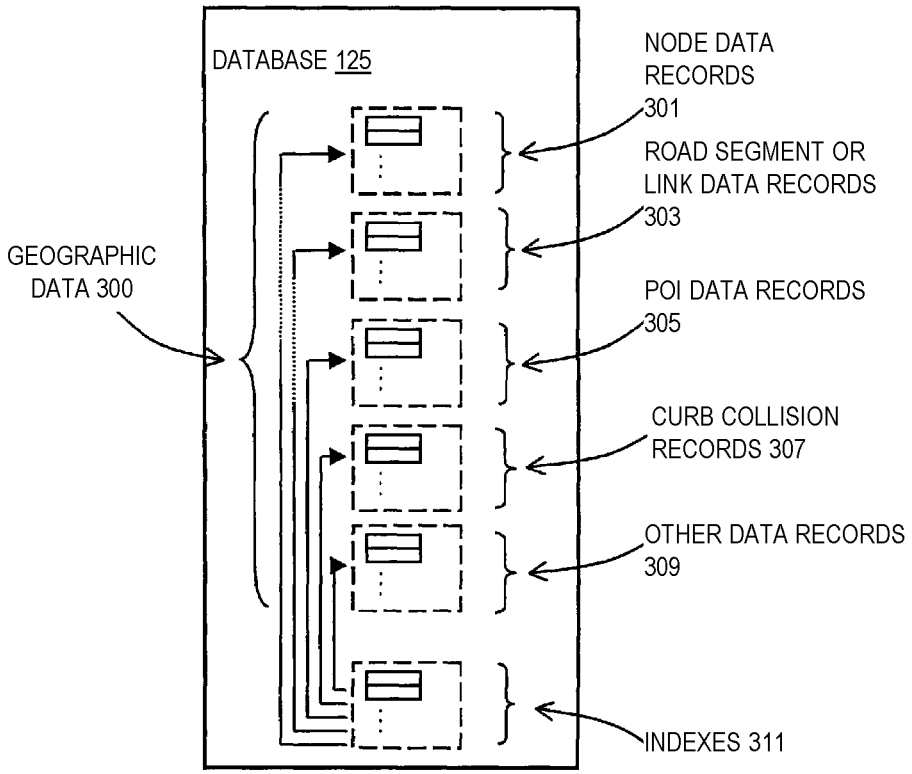
FIG. 3 illustrates a diagram of the database within the system of FIG. 1.

FIG. 3 is a diagram of a database 125 (e.g., a map database), according to one embodiment. In one embodiment, the database 125 includes data 300 used for (or configured to be compiled to be used for) mapping and/or navigation-related services, such as for personalized route determination, according to exemplary embodiments.

In one embodiment, geographic features (e.g., two-dimensional or three-dimensional features) are represented using polygons (e.g., two-dimensional features) or polygon extrusions (e.g., three-dimensional features). For example, the edges of the polygons correspond to the boundaries or edges of the respective geographic feature. In the case of a building, a two-dimensional polygon can be used to represent a footprint of the building, and a three-dimensional polygon extrusion can be used to represent the three-dimensional surfaces of the building. It is contemplated that although various embodiments are discussed with respect to two-dimensional polygons, it is contemplated that the embodiments are also applicable to three-dimensional polygon extrusions, models, routes, etc. Accordingly, the terms polygons and polygon extrusions/models as used herein can be used interchangeably.

In one embodiment, the following terminology applies to the representation of geographic features in the database 125.

"Node"—A point that terminates a link.

"Line segment"—A straight line connecting two points.

"Link" (or "edge")—A contiguous, non-branching string of one or more line segments terminating in a node at each end.

"Shape point"—A point along a link between two nodes (e.g., used to alter a shape of the link without defining new nodes).

"Oriented link"—A link that has a starting node (referred to as the "reference node") and an ending node (referred to as the "non reference node").

"Simple polygon"—An interior area of an outer boundary formed by a string of oriented links that begins and ends in one node. In one embodiment, a simple polygon does not cross itself.

"Polygon"—An area bounded by an outer boundary and none or at least one interior boundary (e.g., a hole or island). In one embodiment, a polygon is constructed from one outer simple polygon and none or at least one inner simple polygon. A polygon is simple if it just consists of one simple polygon, or complex if it has at least one inner simple polygon.

In one embodiment, the database 125 follows certain conventions. For example, links do not cross themselves and do not cross each other except at a node or vertex. Also, there are no duplicated shape points, nodes, or links. Two links that connect each other have a common node or vertex. In the database 125, overlapping geographic features are represented by overlapping polygons. When polygons overlap, the boundary of one polygon crosses the boundary of the other polygon. In the database 125, the location at which the boundary of one polygon intersects they boundary of another polygon is represented by a node. In one embodiment, a node may be used to represent other locations along the boundary of a polygon than a location at which the boundary of the polygon intersects the boundary of another polygon. In one embodiment, a shape point is not used to represent a point at which the boundary of a polygon intersects the boundary of another polygon.

In one embodiment, the database 125 is presented according to a hierarchical or multi-level tile projection. More specifically, in one embodiment, the database 125 may be defined according to a normalized Mercator projection. Other projections may be used. In one embodiment, a map tile grid of a Mercator or similar projection can a multilevel grid. Each cell or tile in a level of the map tile grid is divisible into the same number of tiles of that same level of grid. In other words, the initial level of the map tile grid (e.g., a level at the lowest zoom level) is divisible into four cells or rectangles. Each of those cells are in turn divisible into four cells, and so on until the highest zoom level of the projection is reached.

In one embodiment, the map tile grid may be numbered in a systematic fashion to define a tile identifier (tile ID). For example, the top left tile may be numbered 00, the top right tile may be numbered 01, the bottom left tile may be numbered 10, and the bottom right tile may be numbered 11. In one embodiment, each cell is divided into four rectangles and numbered by concatenating the parent tile ID and the new tile position. A variety of numbering schemes also is possible. Any number of levels with increasingly smaller geographic areas may represent the map tile grid. Any level (n) of the map tile grid has 2(n+1) cells. Accordingly, any tile of the level (n) has a geographic area of A/2(n+1) where A is the total geographic area of the world or the total area of the map tile grids. Because of the numbering system, the exact position of any tile in any level of the map tile grid or projection may be uniquely determined from the tile ID.

As shown, the database 125 includes node data records 301, road segment or link data records 303, POI data records 305, curb collision records 307, other records 309, and indexes 311, for example. More, fewer or different data records can be provided. In one embodiment, additional data records (not shown) can include cartographic ("carto") data records, routing data, and maneuver data. In one embodiment, the indexes 311 may improve the speed of data retrieval operations in the database 125. In one embodiment, the indexes 311 may be used to quickly locate data without having to search every row in the database 125 every time it is accessed.

In exemplary embodiments, the road segment data records 303 are links or segments representing roads, streets, or paths, as can be used in the calculated route or recorded route information for determination of one or more personalized routes. The node data records 301 are end points (such as intersections) corresponding to the respective links or segments of the road segment data records 303. The road link data records 303 and the node data records 301 represent a road network, such as used by vehicles, cars, and/or other entities. Alternatively, the database 125 can contain path segment and node data records or other data that represent pedestrian paths or areas in addition to or instead of the vehicle road record data, for example. In one embodiment, the road or path segments can include an altitude component to extend to paths or road into three-dimensional space (e.g., to cover changes in altitude and contours of different map features, and/or to cover paths traversing a three-dimensional airspace).

Links, segments, and nodes can be associated with attributes, such as geographic coordinates, a number of road objects (e.g., road markings, road signs, traffic light posts, etc.), types of road objects, traffic directions for one or more portions of the links, segments, and nodes, traffic history associated with the links, segments, and nodes, street names, address ranges, speed limits, turn restrictions at intersections, presence of roadworks, and other navigation related attributes, as well as POIs, such as gasoline stations, hotels, restaurants, museums, stadiums, offices, automobile dealerships, auto repair shops, factories, buildings, stores, parks, etc. The database 125 can include data about the POIs and their respective locations in the POI data records 305. The database 125 can also include data about places, such as cities, towns, or other communities, and other geographic features, such as bodies of water, mountain ranges, etc. Such place or feature data can be part of the POI data records 305 or can be associated with POIs or POI data records 305 (such as a data point used for displaying or representing a position of a city).

The curb collision records 307 include historical data indicating events in which drivers have maneuvered vehicles to contact curbs. The historical data are used as a training dataset for training a machine learning model to output a prediction of whether a driver will not see curb. The historical data indicate, for each vehicle that is indicated as a part of the training dataset, vehicle attribute data associated with said vehicle, attributes of one or more environments in which one or more of the curbs is located, and sensor data acquired by said vehicle. The vehicle attribute data indicate specifications of the vehicle such as: (1) a vehicle type; (2) a vehicle height; (3) a wheel width; (4) a wheel height; (5) a vehicle seat height; (6) a thickness between a floor surface of a vehicle cabin and an exterior vehicle surface opposing the floor surface; (7) a distance from a front end of the vehicle to a driver seat; (8) dimensions of a front windshield of the vehicle; (9) a position/orientation of a front windshield relative to the vehicle 105; (10) dimensions of a hood of the vehicle; (11) a position/orientation of the hood; (12) dimensions of various portions of a vehicle; (13) one or more ranges of motion for a vehicle seat; or (14) a combination thereof. The map data indicate attributes of an environment in which a curb is located such as: (1) one or more road curvatures of a road segment or node in which the curb is located; (2) one or more turn restrictions of the road segment or node; (3) a number of lanes within the road segment or node; (4) one or more lane directions for the road segment or node; (5) a functional class for the road segment or node; (6) a speed limit for the road segment or node; (7) one or more physical dividers within the road segment or node; (8) dimensions of the curb; (9) a curvature of the curb; (10) a relative position of the curb with respect to one or more road objects within the road segment or node (e.g., lane markings, a physical divider, another curb, a traffic light post, etc.); or (11) a combination thereof. The sensor data may indicate readings acquired by one or more of the sensors of the vehicle. The sensor data may also indicate attributes of a driver of the vehicle and/or driving patterns of the driver. Specifically, the sensor data may include past sensor data indicating one or more paths of travel for traversing one or more road segments or nodes including one or more other curbs and one or more speed levels for traversing said paths of travel. The past sensor data may also indicate driver behaviors and mannerisms associated with the driver of the vehicle when the vehicle approaches a type of road segment or node. The past sensor data indicating the driver behaviors and mannerisms may be defined, at least in part by: (1) one or more head positions/orientations of the driver of the vehicle; (2) one or more eye directions of the driver; (3) one or more steering wheel angles; or (4) a combination thereof. In one embodiment, historical data further indicate events in which drivers have maneuvered vehicles attached to trailers to contact curbs. Such data include, for each of the vehicle, vehicle attribute data associated with said vehicle, attributes of one or more environments in which one or more of the curbs is located, and sensor data acquired by said vehicle. The data further include, for each trailer attached to said vehicle, trailer attribute data indicating one or more attributes of the trailer such as a model, type, classification, dimensions of the trailer, etc.

Other records 209 may include vehicle attribute data associated with a plurality of vehicles that is not indicated in the historical data, map data indicating attributes of one or more locations that is not indicated in the historical data, sensor data acquired by the plurality of vehicles, and trailer attribute data associated with one or more trailers attached to one or more of the plurality of vehicles.

In one embodiment, the database 125 can be maintained by the services platform 115 and/or one or more of the content providers 119 in association with a map developer. The map developer can collect geographic data to generate and enhance the database 125. There can be different ways used by the map developer to collect data. These ways can include obtaining data from other sources, such as municipalities or respective geographic authorities. In addition, the map developer can employ field personnel to travel by vehicle along roads throughout the geographic region to observe attributes associated with one or more road segments and/or record information about them, for example. Also, remote sensing, such as aerial or satellite photography, can be used.

The database 125 can be a master database stored in a format that facilitates updating, maintenance, and development. For example, the master database or data in the master database can be in an Oracle spatial format or other spatial format (e.g., accommodating different map layers), such as for development or production purposes. The Oracle spatial format or development/production database can be compiled into a delivery format, such as a geographic data files (GDF) format. The data in the production and/or delivery formats can be compiled or further compiled to form database products or databases, which can be used in end user navigation devices or systems.

For example, geographic data is compiled (such as into a platform specification format (PSF) format) to organize and/or configure the data for performing navigation-related functions and/or services, such as route calculation, route guidance, map display, speed calculation, distance and travel time functions, and other functions, by a navigation device, such as by the vehicle 105, for example. The navigation-related functions can correspond to vehicle navigation, pedestrian navigation, or other types of navigation. The compilation to produce the end user databases can be performed by a party or entity separate from the map developer. For example, a customer of the map developer, such as a navigation device developer or other end user device developer, can perform compilation on a received database in a delivery format to produce one or more compiled navigation databases.

The processes described herein for predicting events in which drivers fail to see curbs while the drivers are maneuvering vehicles may be advantageously implemented via software, hardware (e.g., general processor, Digital Signal Processing (DSP) chip, an Application Specific Integrated Circuit (ASIC), Field Programmable Gate Arrays (FPGAs), etc.), firmware, or a combination thereof.

Figure 4:
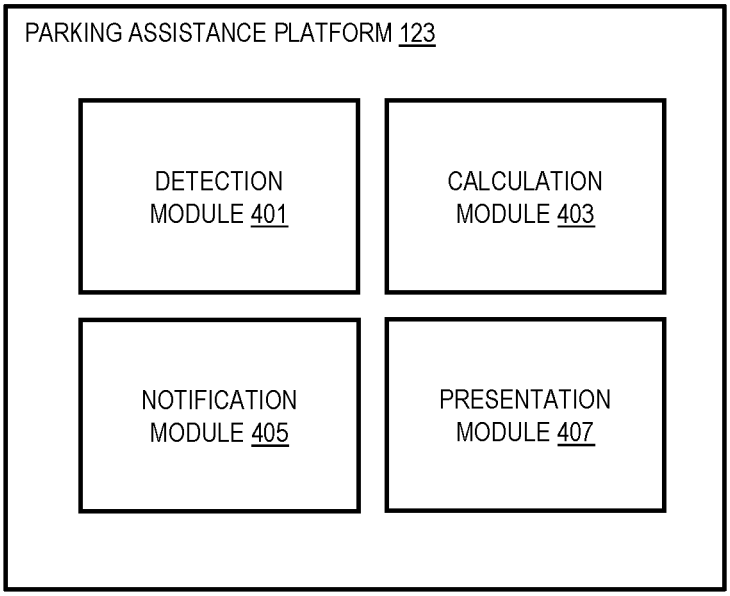
FIG. 4 illustrates a diagram of the components of the curb assessment platform of FIG. 1.

FIG. 4 is a diagram of the components of the curb assessment platform 123, according to one embodiment. By way of example, the curb assessment platform 123 includes one or more components for predicting events in which drivers fail to see curbs while the drivers are maneuvering vehicles. It is contemplated that the functions of these components may be combined in one or more components or performed by other components of equivalent functionality. In this embodiment, the curb assessment platform 123 includes a detection module 401, a calculation module 403, a notification module 405, and a presentation module 407.

The detection module 401 is capable of acquiring input data for a machine learning model that is capable of predicting an event in a driver of the vehicle 105 fails to see a curb while maneuvering the vehicle 105. The input data may be vehicle attribute data associated with the vehicle 105, map data indicating attributes of an environment in which the curb is located, and sensor data acquired by the vehicle 105. In one embodiment, if the vehicle 105 is attached to a trailer, the input data may further indicate trailer attribute data associated with the trailer. The detection module 401 may acquire such data from the vehicle 105, one or more detection entities 113 proximate to the vehicle 105, the services platform 115, one or more content providers 119, the database 125, or a combination thereof. The detection module 401 is also capable of acquiring historical data that are used as a training dataset for training the machine learning render the prediction of whether the driver will not be able to see the curb.

The calculation module 403 embodies the machine learning model and is capable of training the machine learning model to output the prediction by using the historical data as a training dataset. Once the machine learning model is trained, the machine learning model analyses the data input thereto and correlates one or more datapoints of the data to the training dataset. For example, the machine learning model may receive input data indicating that a driver of the vehicle 105 is approaching an intersection including a curb and is attempting to make a turn at a portion of the intersection including the curb. In such example, the machine learning model refers to the training dataset to identify: (1) one or more events in which one or more vehicles have approached the intersection, turned at said portion, and contacted the curb; (2) one or more events in which one or more vehicles have approached one or more intersections having similar attributes as the intersection, turned at one or more portions of said intersections including one or more curbs, and contacted said curbs; or (3) a combination thereof. By way of another example, the machine learning model may receive an input data indicating that: (1) the vehicle 105 is a truck having a first wheel height; and (2) a driver of the vehicle 105 is approaching an intersection including a curb and is attempting to make a turn at a portion of the intersection including the curb. In such example, the machine learning model refers to the training dataset to identify one or more events in which: (1) one or more vehicles is a truck having the first wheel height; and (2) said vehicles have approached the intersection, turned at said portion, and contacted the curb. By way of another example, the machine learning model may receive input data indicating that a driver of the vehicle 105 having first seat adjustment settings is approaching an intersection including a curb and is attempting to make a turn at a portion of the intersection including the curb. In such example, the machine learning model refers to the training dataset to identify one or more events in which one or more drivers having the first seat adjustment settings have maneuvered one or more vehicles to approach one or more other intersections, turn at one or more portions of the one or more other intersections, and contact one or more curbs at the one or more portions. By way of another example, the machine learning model may receive an input data indicating that: (1) a driver of the vehicle 105 is approaching an intersection including a curb and is attempting to make a turn at a portion of the intersection including the curb; and (2) the driver has a pattern of behavior in which the driver focuses his/her attention towards an incoming traffic of an intersecting road segment. In such example, the machine learning model refers to the training dataset to identify one or more events in which: (1) one or more vehicles have approached one or more other intersections, turned at one or more portions of said one or more other intersections, and contacted one or more curbs at the one or more portions; and (2) one or more drivers of said vehicles have the same or similar pattern of behavior as the driver of the vehicle 105. Based on a number of identified events and a degree at which each identified event corresponds to the input data, the machine learning model outputs a likelihood in which the vehicle 105 will contact the curb.

In one embodiment, the calculation module 403 automatically causes the machine learning model to predict whether the vehicle 105 will hit a curb when the calculation module 403 detects that the vehicle 105 satisfies one or more conditions. For example, the calculation module 403 causes the machine learning model to render the prediction when the vehicle 105 approaches an intersection. By way of another example, the calculation module 403 causes the machine learning model to render the prediction when a steering angle of the vehicle 105 exceeds a threshold angle (e.g., more than 35 degrees). In one embodiment, the calculation module 403 periodically causes the machine learning model to predict whether the vehicle 105 will hit a curb. In such embodiment, the calculation module 403 renders the prediction on a curb closest to the vehicle 105 or an upcoming curb within a given route of the vehicle 105.

The notification module 407 may cause a notification on the UE 101 and/or one or more other UEs associated with the vehicle 105. The notification may indicate: (1) a prediction of whether the vehicle 105 and/or a trailer attached to the vehicle 105 will collide with a curb; (2) one or more reasons as to why the vehicle 105 and/or the trailer is likely to collide with the curb; (3) one or more locations of one or more curbs having a "high" level of likelihood in which the vehicle 105 and/or the trailer will collide with said curbs; (4) one or more suggestions for adjusting one or more vehicle settings associated with the vehicle 105 to improve visibility of said curbs for a driver of the vehicle 105 (e.g., adjusting vehicle seats, adjusting mirrors, activating one or more exterior facing cameras of the vehicle 105, etc.); (5) proximity of said curbs with respect to the vehicle 105 and/or the trailer; (6) a projected path of travel for the vehicle 105 and/or the trailer; (7) a calculated path of travel for the vehicle 105 and/or the trailer; or (8) a combination thereof. The notification may include sound notification, display notification, vibration, or a combination thereof.

Figure 5:
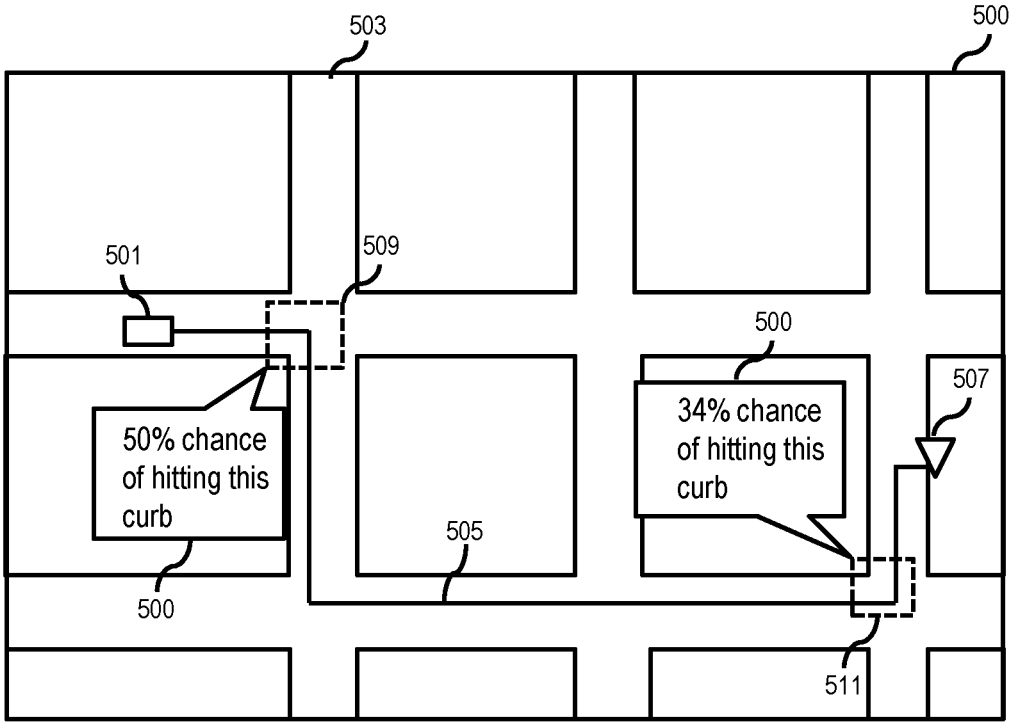
FIG. 5 illustrates a first visual representation of a map indicating one or more locations in which a vehicle is likely hit a curb.
Figure 6:
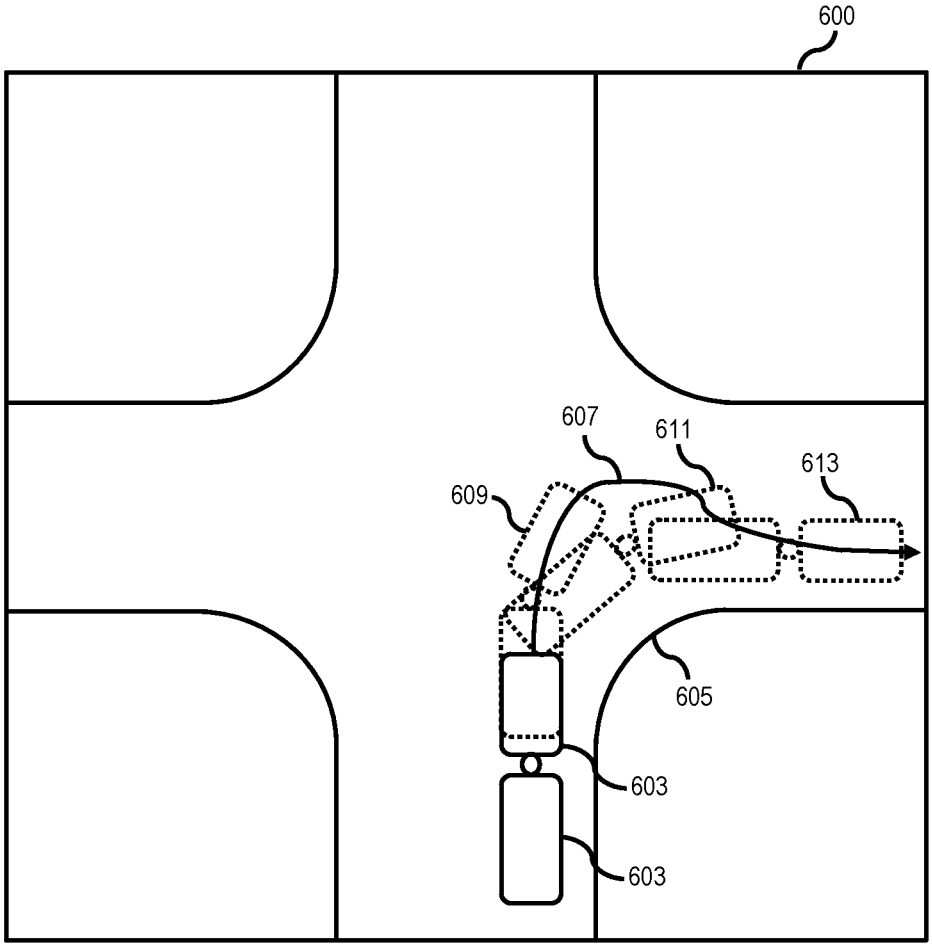
FIG. 6 illustrates a second visual representation indicating a plan view of a vehicle towing a trailer, an environment of the vehicle, and a calculated path of travel for the vehicle.

The presentation module 409 obtains a set of information, data, and/or calculated results from other modules, and continues with providing a visual representation to the UE 101 and/or any other user interface associated with the vehicle 105. The visual representation may indicate any of the information presented by the notification module 407. For example, FIG. 5 illustrates a first visual representation 500 of a map indicating one or more locations in which a vehicle is likely hit a curb. In the illustrated example, a vehicle 501 is traversing a road network 503 and following a route 505 to reach a destination 507. Based on attributes of the vehicle 501, sensor data acquired by the vehicle 501, and map data associated with a first area 509 and second area 511, the calculation module 403 predicts that the vehicle 501 has a 50 percent chance of hitting a curb within the area 509 and a 34 percent chance of hitting a curb within the area 511. As such, the first visual representation 500 includes a first message stating "50% CHANCE OF HITTING THIS CURB" with respect to the first area 509 and a second message stating "34% CHANCE OF HITTING THIS CURB" with respect to the second are 511. By way of another example, FIG. 6 illustrates a second visual representation 600 indicating a plan view of a vehicle towing a trailer, an environment of the vehicle, and a calculated path of travel for the vehicle. In the illustrated example, a vehicle 601 is towing a trailer 603 and is approaching an intersection. The solid outline of the vehicle 601 and the trailer 603 represents a current position of the vehicle 601 and the trailer 603. At this time, the calculation module 403 has predicted that the vehicle 601 and the trailer 603 is likely to hit a curb 605. As such, the second visual representation 600 includes a calculated path of travel 607 for the vehicle 601 that avoids the curb 605. The second visual representation 600 further includes first to third visual aids 609, 611, and 613 to indicate three positions/orientations in which the vehicle 601 should be positioned/oriented at future times to avoid potential collision with the curb 605. Each of the first to third visual aids 609, 611, and 613 is presented as a dotted outline of the vehicle 601 and the trailer 603 to resemble each of the three positions/orientations. It is contemplated that the second visual representation 600 may include additional visual aids such as one or more suggestions indicating one or more steering wheel angles at one or more positions/orientations of the vehicle 601 with respect to the location of the curb 605.

The above presented modules and components of the curb assessment platform 123 can be implemented in hardware, firmware, software, or a combination thereof. Though depicted as a separate entity in FIG. 4, it is contemplated that the curb assessment platform 123 may be implemented for direct operation by the UE 101, the vehicle 105, the services platform 115, one or more of the content providers 119, or a combination thereof. As such, the curb assessment platform 123 may generate direct signal inputs by way of the operating system of the UE 101, the vehicle 105, the services platform 115, the one or more of the content providers 119, or the combination thereof for interacting with the applications 103. The various executions presented herein contemplate any and all arrangements and models.

Figure 7:
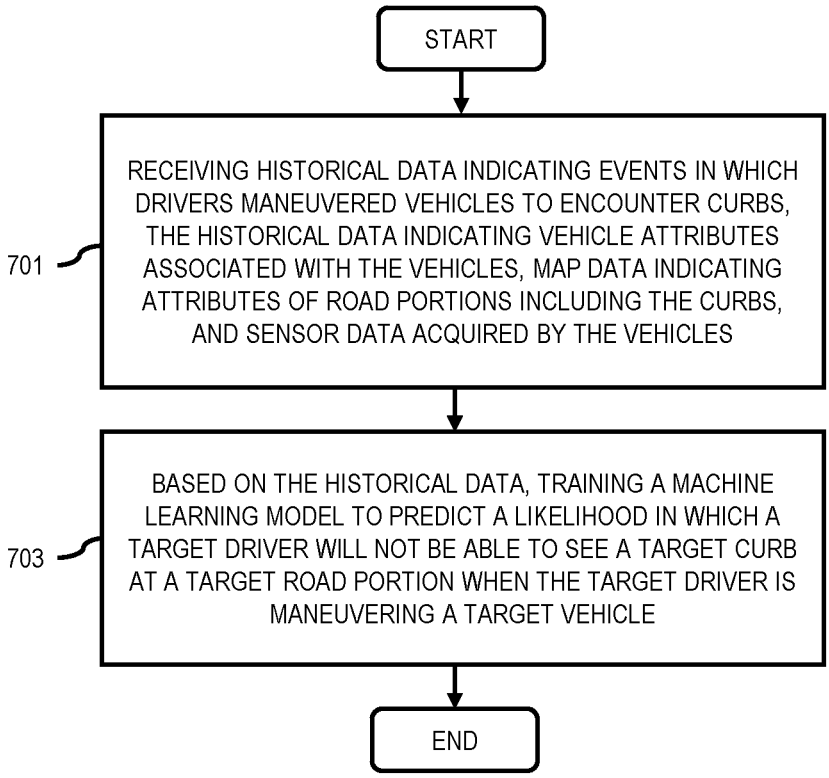
FIG. 7 illustrates a flowchart of a process for training a machine learning model to predict a likelihood in which a driver will not be able to see a curb.
Figure 10:
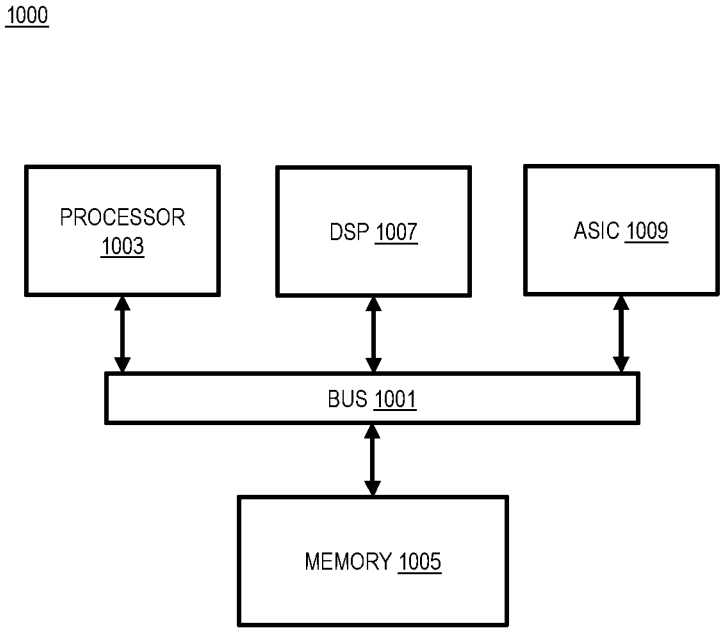
FIG. 10 illustrates a chip set or chip upon which an embodiment may be implemented.

FIG. 7 is a flowchart of a process 700 for training a machine learning model to predict a likelihood in which a driver will not be able to see a curb, according to one embodiment. In one embodiment, the curb assessment platform 123 performs the process 700 and is implemented in, for instance, a chip set including a processor and a memory as shown in FIG. 10.

In step 701, the curb assessment platform 123 receives historical data indicating events in which drivers maneuvered vehicles to encounter curbs. The historical data indicate vehicle attributes associated with the vehicles, map data indicating attributes of road portions including the curbs, and sensor data acquired by the vehicles. The vehicle attribute data indicate, for each of the vehicles, specifications of said vehicle such as: (1) a vehicle type; (2) a vehicle height; (3) a wheel width; (4) a wheel height; (5) a vehicle seat height; (6) a thickness between a floor surface of a vehicle cabin and an exterior vehicle surface opposing the floor surface; (7) a distance from a front end of the vehicle to a driver seat; (8) dimensions of a front windshield of the vehicle; (9) a position/orientation of a front windshield relative to the vehicle; (10) dimensions of a hood of the vehicle; (11) a position/orientation of the hood; (12) dimensions of various portions of a vehicle; (13) one or more ranges of motion for a vehicle seat; or (14) a combination thereof. The map data indicate, for each of the curbs, attributes of an environment in which the curb is located such as: (1) one or more road curvatures of a road segment or node in which the curb is located; (2) one or more turn restrictions of the road segment or node; (3) a number of lanes within the road segment or node; (4) one or more lane directions for the road segment or node; (5) a functional class for the road segment or node; (6) a speed limit for the road segment or node; (7) one or more physical dividers within the road segment or node; (8) dimensions of the curb; (9) a curvature of the curb; (10) a relative position of the curb with respect to one or more road objects within the road segment or node (e.g., lane markings, a physical divider, another curb, a traffic light post, etc.); or (11) a combination thereof. The sensor data may indicate, for each of the vehicles, readings acquired by one or more of the sensors of the vehicle during a period in which the vehicle has approached a location of the curb. For example, the sensor data may indicate: (1) a relative position of the vehicle within a portion of a road including the curb; (2) a current speed of the vehicle; (3) a heading of the vehicle; or (4) a combination thereof. The sensor data may also indicate attributes of a driver of the vehicle and/or driving patterns of the driver. Specifically, the sensor data may include past sensor data indicating one or more paths of travel for traversing one or more road segments or nodes including one or more other curbs and one or more speed levels for traversing said paths of travel. The past sensor data may also indicate driver behaviors and mannerisms associated with the driver of the vehicle when the vehicle approaches a type of road segment or node. The past sensor data indicating the driver behaviors and mannerisms may be defined, at least in part by: (1) one or more head positions/orientations of the driver of the vehicle; (2) one or more eye directions of the driver; (3) one or more steering wheel angles; or (4) a combination thereof. In one embodiment, the sensor data may indicate vehicle seat adjustment settings associated with one or more vehicle seats within the vehicle. In such embodiment, the curb assessment platform 123 uses the vehicle seat adjustment settings to estimate an orientation of a person sitting on one of the vehicle seats.

In step 703, the curb assessment platform 123 trains a machine learning model to predict a likelihood in which a target driver will not be able to see a target curb at a target road portion when the target driver is maneuvering a target vehicle based on the historical data. The target driver, the target curb, the target road portion, and the target vehicle indicate objects of interest, where the objects of interest are objects on which the machine learning model renders a prediction. When the machine learning model is trained, the machine learning model uses the historical data to correlate the target driver, the target curb, the target road portion, and the target vehicle to one or more corresponding aspects of past events in which drivers have maneuvered vehicles to contact curbs.

Figure 8:
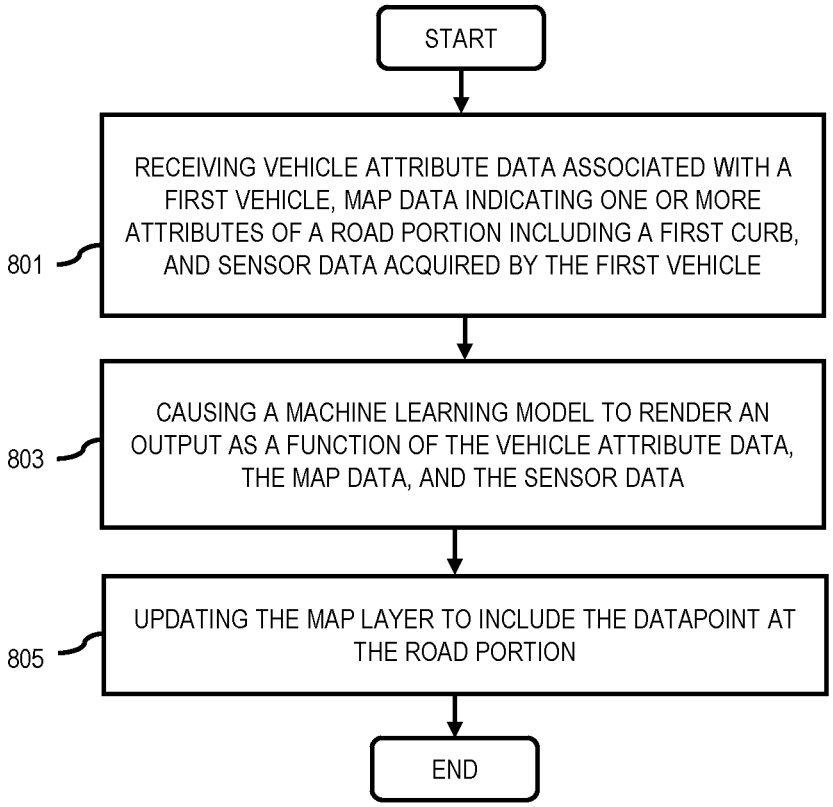
FIG. 8 illustrates a flowchart of a process for using a machine learning model to provide a map layer of predicted events in which drivers fail to see curbs while the drivers are maneuvering vehicles.

FIG. 8 is a flowchart of a process 800 for using a machine learning model to provide a map layer of predicted events in which drivers fail to see curbs while the drivers are maneuvering vehicles, according to one embodiment. In one embodiment, the curb assessment platform 123 performs the process 800 and is implemented in, for instance, a chip set including a processor and a memory as shown in FIG. 10.

In step 801, the curb assessment platform 123 receives vehicle attribute data associated with a first vehicle, map data indicating one or more attributes of a road portion including a first curb, and sensor data acquired by the first vehicle.

In step 803, the curb assessment platform 123 causes a machine learning model to render an output as a function of the vehicle attribute data, the map data, and the sensor data. The output indicates a likelihood of which the first driver will not be able to see the first curb at the road portion when the first driver is maneuvering the first vehicle The machine learning model is trained to predict the output based on historical data indicating events in which second drivers maneuvered second vehicles to encounter the first curb or one or more second curbs.

In step 805, the curb assessment platform 123 updates the map layer to include the datapoint at the road portion. The map layer includes one or more other datapoints indicating one or more other likelihoods of which the first driver will not be able to see the one or more second curbs, one or more third curbs, or a combination thereof at one or more other road portions when the first driver is maneuvering the first vehicle.

The system, apparatus, and methods described herein provide one or more predictions indicating events in which a driver will not be able to see a curb while the driver is maneuvering a vehicle based on historical data of past events in which drivers maneuvered vehicles to contact curbs, thereby enabling the vehicle to pre-emptively provide notifications regarding the location of the curb and further provide guidance for assisting the driver to avoid the curb while maneuvering the vehicle. Since the system uses the predictions to lower the likelihood of drivers maneuvering vehicles to inadvertently contact curbs, the likelihood in which vehicles are damaged due to the vehicles colliding with curbs is lowered.

The processes described herein may be advantageously implemented via software, hardware, firmware or a combination of software and/or firmware and/or hardware. For example, the processes described herein, may be advantageously implemented via processor(s), Digital Signal Processing (DSP) chip, an Application Specific Integrated Circuit (ASIC), Field Programmable Gate Arrays (FPGAs), etc. Such exemplary hardware for performing the described functions is detailed below.

Figure 9:
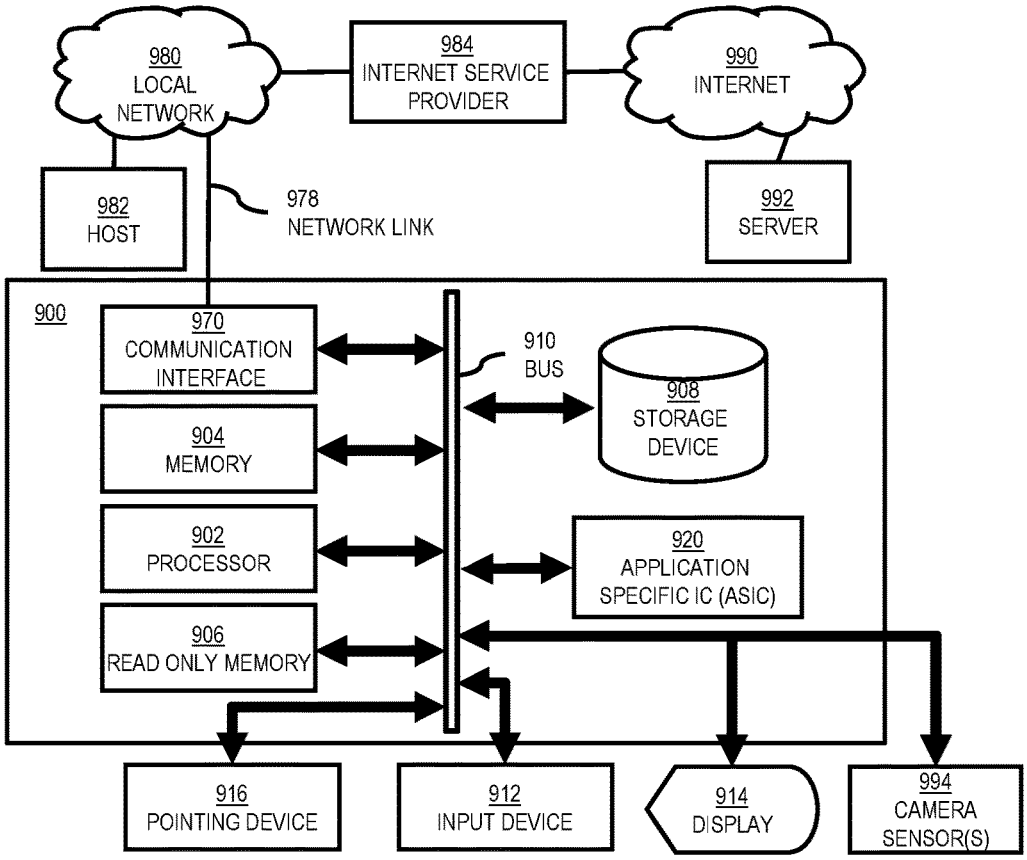
FIG. 9 illustrates a computer system upon which an embodiment may be implemented.

FIG. 9 illustrates a computer system 900 upon which an embodiment of the invention may be implemented. Although computer system 900 is depicted with respect to a particular device or equipment, it is contemplated that other devices or equipment (e.g., network elements, servers, etc.) within FIG. 9 can deploy the illustrated hardware and components of system 900. Computer system 900 is programmed (e.g., via computer program code or instructions) to predict events in which drivers fail to see curbs while the drivers are maneuvering vehicles as described herein and includes a communication mechanism such as a bus 910 for passing information between other internal and external components of the computer system 900. Information (also called data) is represented as a physical expression of a measurable phenomenon, typically electric voltages, but including, in other embodiments, such phenomena as magnetic, electromagnetic, pressure, chemical, biological, molecular, atomic, sub-atomic and quantum interactions. For example, north and south magnetic fields, or a zero and non-zero electric voltage, represent two states (0, 1) of a binary digit (bit). Other phenomena can represent digits of a higher base. A superposition of multiple simultaneous quantum states before measurement represents a quantum bit (qubit). A sequence of one or more digits constitutes digital data that is used to represent a number or code for a character. In some embodiments, information called analog data is represented by a near continuum of measurable values within a particular range. Computer system 900, or a portion thereof, constitutes a means for performing one or more steps of predicting events in which drivers fail to see curbs while the drivers are maneuvering vehicles.

A bus 910 includes one or more parallel conductors of information so that information is transferred quickly among devices coupled to the bus 910. One or more processors 902 for processing information are coupled with the bus 910.

A processor (or multiple processors) 902 performs a set of operations on information as specified by computer program code related to predicting events in which drivers fail to see curbs while the drivers are maneuvering vehicles. The computer program code is a set of instructions or statements providing instructions for the operation of the processor and/or the computer system to perform specified functions. The code, for example, may be written in a computer programming language that is compiled into a native instruction set of the processor. The code may also be written directly using the native instruction set (e.g., machine language). The set of operations include bringing information in from the bus 910 and placing information on the bus 910. The set of operations also typically include comparing two or more units of information, shifting positions of units of information, and combining two or more units of information, such as by addition or multiplication or logical operations like OR, exclusive OR (XOR), and AND. Each operation of the set of operations that can be performed by the processor is represented to the processor by information called instructions, such as an operation code of one or more digits. A sequence of operations to be executed by the processor 902, such as a sequence of operation codes, constitute processor instructions, also called computer system instructions or, simply, computer instructions. Processors may be implemented as mechanical, electrical, magnetic, optical, chemical, or quantum components, among others, alone or in combination.

Computer system 900 also includes a memory 904 coupled to bus 910. The memory 904, such as a random access memory (RAM) or any other dynamic storage device, stores information including processor instructions for predicting events in which drivers fail to see curbs while the drivers are maneuvering vehicles. Dynamic memory allows information stored therein to be changed by the computer system 900. RAM allows a unit of information stored at a location called a memory address to be stored and retrieved independently of information at neighboring addresses. The memory 904 is also used by the processor 902 to store temporary values during execution of processor instructions. The computer system 900 also includes a read only memory (ROM) 906 or any other static storage device coupled to the bus 910 for storing static information, including instructions, that is not changed by the computer system 900. Some memory is composed of volatile storage that loses the information stored thereon when power is lost. Also coupled to bus 910 is a non-volatile (persistent) storage device 908, such as a magnetic disk, optical disk or flash card, for storing information, including instructions, that persists even when the computer system 900 is turned off or otherwise loses power.

Information, including instructions for predicting events in which drivers fail to see curbs while the drivers are maneuvering vehicles, is provided to the bus 910 for use by the processor from an external input device 912, such as a keyboard containing alphanumeric keys operated by a human user, a microphone, an Infrared (IR) remote control, a joystick, a game pad, a stylus pen, a touch screen, or a sensor. A sensor detects conditions in its vicinity and transforms those detections into physical expression compatible with the measurable phenomenon used to represent information in computer system 900. Other external devices coupled to bus 910, used primarily for interacting with humans, include a display device 914, such as a cathode ray tube (CRT), a liquid crystal display (LCD), a light emitting diode (LED) display, an organic LED (OLED) display, a plasma screen, or a printer for presenting text or images, and a pointing device 916, such as a mouse, a trackball, cursor direction keys, or a motion sensor, for controlling a position of a small cursor image presented on the display 914 and issuing commands associated with graphical elements presented on the display 914, and one or more camera sensors 994 for capturing, recording and causing to store one or more still and/or moving images (e.g., videos, movies, etc.) which also may comprise audio recordings. In some embodiments, for example, in embodiments in which the computer system 900 performs all functions automatically without human input, one or more of external input device 912, display device 914 and pointing device 916 may be omitted.

In the illustrated embodiment, special purpose hardware, such as an application specific integrated circuit (ASIC) 920, is coupled to bus 910. The special purpose hardware is configured to perform operations not performed by processor 902 quickly enough for special purposes. Examples of ASICs include graphics accelerator cards for generating images for display 914, cryptographic boards for encrypting and decrypting messages sent over a network, speech recognition, and interfaces to special external devices, such as robotic arms and medical scanning equipment that repeatedly perform some complex sequence of operations that are more efficiently implemented in hardware.

Computer system 900 also includes one or more instances of a communications interface 970 coupled to bus 910. Communication interface 970 provides a one-way or two-way communication coupling to a variety of external devices that operate with their own processors, such as printers, scanners and external disks. In general the coupling is with a network link 978 that is connected to a local network 980 to which a variety of external devices with their own processors are connected. For example, communication interface 970 may be a parallel port or a serial port or a universal serial bus (USB) port on a personal computer. In some embodiments, communications interface 970 is an integrated services digital network (ISDN) card or a digital subscriber line (DSL) card or a telephone modem that provides an information communication connection to a corresponding type of telephone line. In some embodiments, a communication interface 970 is a cable modem that converts signals on bus 910 into signals for a communication connection over a coaxial cable or into optical signals for a communication connection over a fiber optic cable. As another example, communications interface 970 may be a local area network (LAN) card to provide a data communication connection to a compatible LAN, such as Ethernet. Wireless links may also be implemented. For wireless links, the communications interface 970 sends or receives or both sends and receives electrical, acoustic or electromagnetic signals, including infrared and optical signals, that carry information streams, such as digital data. For example, in wireless handheld devices, such as mobile telephones like cell phones, the communications interface 970 includes a radio band electromagnetic transmitter and receiver called a radio transceiver. In certain embodiments, the communications interface 970 enables connection to the communication network 121 for predicting events in which drivers fail to see curbs while the drivers are maneuvering vehicles to the UE 101.

The term "computer-readable medium" as used herein refers to any medium that participates in providing information to processor 902, including instructions for execution. Such a medium may take many forms, including, but not limited to computer-readable storage medium (e.g., non-volatile media, volatile media), and transmission media. Non-transitory media, such as non-volatile media, include, for example, optical or magnetic disks, such as storage device 908. Volatile media include, for example, dynamic memory 904. Transmission media include, for example, twisted pair cables, coaxial cables, copper wire, fiber optic cables, and carrier waves that travel through space without wires or cables, such as acoustic waves and electromagnetic waves, including radio, optical and infrared waves. Signals include man-made transient variations in amplitude, frequency, phase, polarization or other physical properties transmitted through the transmission media. Common forms of computer-readable media include, for example, a floppy disk, a flexible disk, hard disk, magnetic tape, any other magnetic medium, a CD-ROM, CDRW, DVD, any other optical medium, punch cards, paper tape, optical mark sheets, any other physical medium with patterns of holes or other optically recognizable indicia, a RAM, a PROM, an EPROM, a FLASH-EPROM, an EEPROM, a flash memory, any other memory chip or cartridge, a carrier wave, or any other medium from which a computer can read. The term computer-readable storage medium is used herein to refer to any computer-readable medium except transmission media.

Logic encoded in one or more tangible media includes one or both of processor instructions on a computer-readable storage media and special purpose hardware, such as ASIC 920.

Network link 978 typically provides information communication using transmission media through one or more networks to other devices that use or process the information. For example, network link 978 may provide a connection through local network 980 to a host computer 982 or to equipment 984 operated by an Internet Service Provider (ISP). ISP equipment 984 in turn provides data communication services through the public, world-wide packet-switching communication network of networks now commonly referred to as the Internet 990.

A computer called a server host 982 connected to the Internet hosts a process that provides a service in response to information received over the Internet. For example, server host 982 hosts a process that provides information representing video data for presentation at display 914. It is contemplated that the components of system 900 can be deployed in various configurations within other computer systems, e.g., host 982 and server 992.

At least some embodiments of the invention are related to the use of computer system 900 for implementing some or all of the techniques described herein. According to one embodiment of the invention, those techniques are performed by computer system 900 in response to processor 902 executing one or more sequences of one or more processor instructions contained in memory 904. Such instructions, also called computer instructions, software and program code, may be read into memory 904 from another computer-readable medium such as storage device 908 or network link 978. Execution of the sequences of instructions contained in memory 904 causes processor 902 to perform one or more of the method steps described herein. In alternative embodiments, hardware, such as ASIC 920, may be used in place of or in combination with software to implement the invention. Thus, embodiments of the invention are not limited to any specific combination of hardware and software, unless otherwise explicitly stated herein.

The signals transmitted over network link 978 and other networks through communications interface 970, carry information to and from computer system 900. Computer system 900 can send and receive information, including program code, through the networks 980, 990 among others, through network link 978 and communications interface 970. In an example using the Internet 990, a server host 982 transmits program code for a particular application, requested by a message sent from computer 900, through Internet 990, ISP equipment 984, local network 980 and communications interface 970. The received code may be executed by processor 902 as it is received, or may be stored in memory 904 or in storage device 908 or any other non-volatile storage for later execution, or both. In this manner, computer system 900 may obtain application program code in the form of signals on a carrier wave.

Various forms of computer readable media may be involved in carrying one or more sequence of instructions or data or both to processor 902 for execution. For example, instructions and data may initially be carried on a magnetic disk of a remote computer such as host 982. The remote computer loads the instructions and data into its dynamic memory and sends the instructions and data over a telephone line using a modem. A modem local to the computer system 900 receives the instructions and data on a telephone line and uses an infra-red transmitter to convert the instructions and data to a signal on an infra-red carrier wave serving as the network link 978. An infrared detector serving as communications interface 970 receives the instructions and data carried in the infrared signal and places information representing the instructions and data onto bus 910. Bus 910 carries the information to memory 904 from which processor 902 retrieves and executes the instructions using some of the data sent with the instructions. The instructions and data received in memory 904 may optionally be stored on storage device 908, either before or after execution by the processor 902.

FIG. 10 illustrates a chip set or chip 1000 upon which an embodiment of the invention may be implemented. Chip set 1000 is programmed to predict events in which drivers fail to see curbs while the drivers are maneuvering vehicles as described herein and includes, for instance, the processor and memory components described with respect to FIG. 9 incorporated in one or more physical packages (e.g., chips). By way of example, a physical package includes an arrangement of one or more materials, components, and/or wires on a structural assembly (e.g., a baseboard) to provide one or more characteristics such as physical strength, conservation of size, and/or limitation of electrical interaction. It is contemplated that in certain embodiments the chip set 1000 can be implemented in a single chip. It is further contemplated that in certain embodiments the chip set or chip 1000 can be implemented as a single "system on a chip." It is further contemplated that in certain embodiments a separate ASIC would not be used, for example, and that all relevant functions as disclosed herein would be performed by a processor or processors. Chip set or chip 1000, or a portion thereof, constitutes a means for performing one or more steps of providing user interface navigation information associated with the availability of functions. Chip set or chip 1000, or a portion thereof, constitutes a means for performing one or more steps of predicting events in which drivers fail to see curbs while the drivers are maneuvering vehicles.

In one embodiment, the chip set or chip 1000 includes a communication mechanism such as a bus 1001 for passing information among the components of the chip set 1000. A processor 1003 has connectivity to the bus 1001 to execute instructions and process information stored in, for example, a memory 1005. The processor 1003 may include one or more processing cores with each core configured to perform independently. A multi-core processor enables multiprocessing within a single physical package. Examples of a multi-core processor include two, four, eight, or greater numbers of processing cores. Alternatively or in addition, the processor 1003 may include one or more microprocessors configured in tandem via the bus 1001 to enable independent execution of instructions, pipelining, and multithreading. The processor 1003 may also be accompanied with one or more specialized components to perform certain processing functions and tasks such as one or more digital signal processors (DSP) 1007, or one or more application-specific integrated circuits (ASIC) 1009. A DSP 1007 typically is configured to process real-world signals (e.g., sound) in real-time independently of the processor 1003. Similarly, an ASIC 1009 can be configured to performed specialized functions not easily performed by a more general purpose processor. Other specialized components to aid in performing the inventive functions described herein may include one or more field programmable gate arrays (FPGA), one or more controllers, or one or more other special-purpose computer chips.

In one embodiment, the chip set or chip 1000 includes merely one or more processors and some software and/or firmware supporting and/or relating to and/or for the one or more processors. The processor 1003 and accompanying components have connectivity to the memory 1005 via the bus 1001. The memory 1005 includes both dynamic memory (e.g., RAM, magnetic disk, writable optical disk, etc.) and static memory (e.g., ROM, CD-ROM, etc.) for storing executable instructions that when executed perform the inventive steps described herein to predict events in which drivers fail to see curbs while the drivers are maneuvering vehicles. The memory 1005 also stores the data associated with or generated by the execution of the inventive steps.

Figure 11:
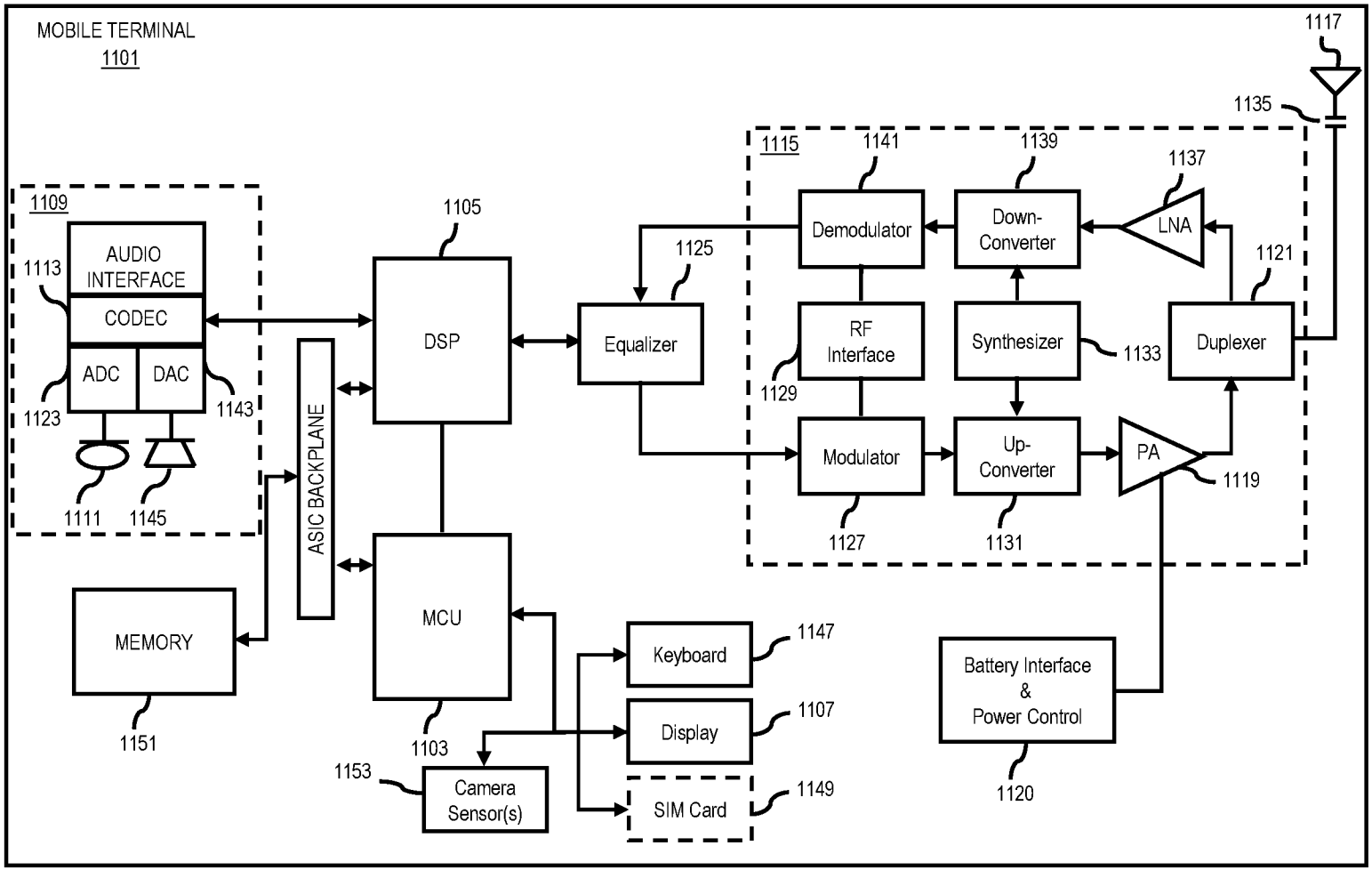
FIG. 11 illustrates a diagram of exemplary components of a mobile terminal for communications, which is capable of operating in the system of FIG. 1.

FIG. 11 is a diagram of exemplary components of a mobile terminal 1101 (e.g., a mobile device or vehicle or part thereof) for communications, which is capable of operating in the system of FIG. 1, according to one embodiment. In some embodiments, mobile terminal 1101, or a portion thereof, constitutes a means for performing one or more steps of predicting events in which drivers fail to see curbs while the drivers are maneuvering vehicles. Generally, a radio receiver is often defined in terms of front-end and back-end characteristics. The front-end of the receiver encompasses all of the Radio Frequency (RF) circuitry whereas the back-end encompasses all of the base-band processing circuitry. As used in this application, the term "circuitry" refers to both: (1) hardware-only implementations (such as implementations in only analog and/or digital circuitry), and (2) to combinations of circuitry and software (and/or firmware) (such as, if applicable to the particular context, to a combination of processor(s), including digital signal processor(s), software, and memory(ies) that work together to cause an apparatus, such as a mobile phone or server, to perform various functions). This definition of "circuitry" applies to all uses of this term in this application, including in any claims. As a further example, as used in this application and if applicable to the particular context, the term "circuitry" would also cover an implementation of merely a processor (or multiple processors) and its (or their) accompanying software/or firmware. The term "circuitry" would also cover if applicable to the particular context, for example, a baseband integrated circuit or applications processor integrated circuit in a mobile phone or a similar integrated circuit in a cellular network device or other network devices.

Pertinent internal components of the telephone include a Main Control Unit (MCU) 1103, a Digital Signal Processor (DSP) 1105, and a receiver/transmitter unit including a microphone gain control unit and a speaker gain control unit. A main display unit 1107 provides a display to the user in support of various applications and mobile terminal functions that perform or support the steps of predicting events in which drivers fail to see curbs while the drivers are maneuvering vehicles. The display 1107 includes display circuitry configured to display at least a portion of a user interface of the mobile terminal (e.g., mobile telephone). Additionally, the display 1107 and display circuitry are configured to facilitate user control of at least some functions of the mobile terminal. An audio function circuitry 1109 includes a microphone 1111 and microphone amplifier that amplifies the speech signal output from the microphone 1111. The amplified speech signal output from the microphone 1111 is fed to a coder/decoder (CODEC) 1113.

A radio section 1115 amplifies power and converts frequency in order to communicate with a base station, which is included in a mobile communication system, via antenna 1117. The power amplifier (PA) 1119 and the transmitter/modulation circuitry are operationally responsive to the MCU 1103, with an output from the PA 1119 coupled to the duplexer 1121 or circulator or antenna switch, as known in the art. The PA 1119 also couples to a battery interface and power control unit 1120.

In use, a user of mobile terminal 1101 speaks into the microphone 1111 and his or her voice along with any detected background noise is converted into an analog voltage. The analog voltage is then converted into a digital signal through the Analog to Digital Converter (ADC) 1123. The control unit 1103 routes the digital signal into the DSP 1105 for processing therein, such as speech encoding, channel encoding, encrypting, and interleaving. In one embodiment, the processed voice signals are encoded, by units not separately shown, using a cellular transmission protocol such as enhanced data rates for global evolution (EDGE), general packet radio service (GPRS), global system for mobile communications (GSM), Internet protocol multimedia subsystem (IMS), universal mobile telecommunications system (UMTS), etc., as well as any other suitable wireless medium, e.g., microwave access (WiMAX), Long Term Evolution (LTE) networks, code division multiple access (CDMA), wideband code division multiple access (WCDMA), wireless fidelity (WiFi), satellite, and the like, or any combination thereof.

The encoded signals are then routed to an equalizer 1125 for compensation of any frequency-dependent impairments that occur during transmission though the air such as phase and amplitude distortion. After equalizing the bit stream, the modulator 1127 combines the signal with a RF signal generated in the RF interface 1129. The modulator 1127 generates a sine wave by way of frequency or phase modulation. In order to prepare the signal for transmission, an up-converter 1131 combines the sine wave output from the modulator 1127 with another sine wave generated by a synthesizer 1133 to achieve the desired frequency of transmission. The signal is then sent through a PA 1119 to increase the signal to an appropriate power level. In practical systems, the PA 1119 acts as a variable gain amplifier whose gain is controlled by the DSP 1105 from information received from a network base station. The signal is then filtered within the duplexer 1121 and optionally sent to an antenna coupler 1135 to match impedances to provide maximum power transfer. Finally, the signal is transmitted via antenna 1117 to a local base station. An automatic gain control (AGC) can be supplied to control the gain of the final stages of the receiver. The signals may be forwarded from there to a remote telephone which may be another cellular telephone, any other mobile phone or a land-line connected to a Public Switched Telephone Network (PSTN), or other telephony networks.

Voice signals transmitted to the mobile terminal 1101 are received via antenna 1117 and immediately amplified by a low noise amplifier (LNA) 1137. A down-converter 1139 lowers the carrier frequency while the demodulator 1141 strips away the RF leaving only a digital bit stream. The signal then goes through the equalizer 1125 and is processed by the DSP 1105. A Digital to Analog Converter (DAC) 1143 converts the signal and the resulting output is transmitted to the user through the speaker 1145, all under control of a Main Control Unit (MCU) 1103 which can be implemented as a Central Processing Unit (CPU).

The MCU 1103 receives various signals including input signals from the keyboard 1147. The keyboard 1147 and/or the MCU 1103 in combination with other user input components (e.g., the microphone 1111) comprise a user interface circuitry for managing user input. The MCU 1103 runs a user interface software to facilitate user control of at least some functions of the mobile terminal 1101 to predict events in which drivers fail to see curbs while the drivers are maneuvering vehicles. The MCU 1103 also delivers a display command and a switch command to the display 1107 and to the speech output switching controller, respectively. Further, the MCU 1103 exchanges information with the DSP 1105 and can access an optionally incorporated SIM card 1149 and a memory 1151. In addition, the MCU 1103 executes various control functions required of the terminal. The DSP 1105 may, depending upon the implementation, perform any of a variety of conventional digital processing functions on the voice signals. Additionally, DSP 1105 determines the background noise level of the local environment from the signals detected by microphone 1111 and sets the gain of microphone 1111 to a level selected to compensate for the natural tendency of the user of the mobile terminal 1101.

The CODEC 1113 includes the ADC 1123 and DAC 1143. The memory 1151 stores various data including call incoming tone data and is capable of storing other data including music data received via, e.g., the global Internet. The software module could reside in RAM memory, flash memory, registers, or any other form of writable storage medium known in the art. The memory device 1151 may be, but not limited to, a single memory, CD, DVD, ROM, RAM, EEPROM, optical storage, magnetic disk storage, flash memory storage, or any other non-volatile storage medium capable of storing digital data.

An optionally incorporated SIM card 1149 carries, for instance, important information, such as the cellular phone number, the carrier supplying service, subscription details, and security information. The SIM card 1149 serves primarily to identify the mobile terminal 1101 on a radio network. The card 1149 also contains a memory for storing a personal telephone number registry, text messages, and user specific mobile terminal settings.

Further, one or more camera sensors 1153 may be incorporated onto the mobile station 1101 wherein the one or more camera sensors may be placed at one or more locations on the mobile station. Generally, the camera sensors may be utilized to capture, record, and cause to store one or more still and/or moving images (e.g., videos, movies, etc.) which also may comprise audio recordings.

While the invention has been described in connection with a number of embodiments and implementations, the invention is not so limited but covers various obvious modifications and equivalent arrangements, which fall within the purview of the appended claims. Although features of the invention are expressed in certain combinations among the claims, it is contemplated that these features can be arranged in any combination and order.

We claim:

1. An apparatus comprising at least one processor and at least one non-transitory memory including computer program code instructions, the computer program code instructions configured to, when executed, cause the apparatus to:

receive historical data indicating events in which drivers maneuvered vehicles to encounter curbs, the historical data indicating vehicle attributes associated with the vehicles, map data indicating attributes of road portions including the curbs, and sensor data indicating orientations of drivers within the vehicles;

based on the historical data, train a machine learning model to predict a likelihood in which a target driver will not be able to see a target curb at a target road portion when the target driver is maneuvering a target vehicle; and update a map layer to include the likelihood at the target road portion.

2. The apparatus of claim 1, wherein the sensor data indicate height levels of eyes of the drivers within the vehicle with respect to a ground level.

3. The apparatus of claim 1, wherein the vehicle attribute data indicate a vehicle type, a vehicle height, a wheel width, a wheel height, a vehicle seat height, a thickness between a floor surface of a vehicle cabin and an exterior vehicle surface opposing the floor surface, one or more ranges of motion of the vehicle seat, or a combination thereof.

4. The apparatus of claim 1, wherein the map data indicate one or more road curvatures of one or more of the road portions, one or more turn restrictions of the one or more of the road portions, a number of lanes for each of the road portions, one or more lane directions for each of the road portions, a functional class for each of the road portions, a speed limit for each of the road portions, one or more physical dividers within the one or more of the road portions, dimensions of the curbs, curvatures of the curbs, one or more relative positions of one or more of the curbs with respect to one or more road objects within the one or more of the road portions, or a combination thereof.

5. The apparatus of claim 4, wherein the one or more road objects is one or more road surface markings, one or more traffic lights, or a combination thereof.

6. The apparatus of claim 1, wherein the sensor data indicate one or more first images acquired by one or more exterior facing cameras equipped by the vehicles, one or more second images acquired by one or more interior facing cameras equipped by the vehicles, radar or ultrasonic data indicating proximity of physical objects with respect to one or more proximity sensors equipped by the vehicles, steering wheel angles of the vehicles, wheel angels of the vehicles, a number of brake activations executed by the vehicles, acceleration data acquired by one or more accelerometers equipped by the vehicles, vehicle seat adjustment settings associated with the vehicles, side view mirror settings associated with the vehicles, or a combination thereof.

7. A non-transitory computer-readable storage medium having computer program code instructions stored therein, the computer program code instructions, when executed by at least one processor, cause the at least one processor to:

receive vehicle attribute data associated with a first vehicle, map data indicating one or more attributes of a road portion including a first curb, and sensor data indicating an orientation of a first driver within the first vehicle;

cause a machine learning model to render an output as a function of the vehicle attribute data, the map data, and the sensor data, wherein the output indicates a likelihood of which the first driver will not be able to see the first curb at the road portion when the first driver is maneuvering the first vehicle, and wherein the machine learning model is trained to predict the output based on historical data indicating events in which second drivers maneuvered second vehicles to encounter the first curb or one or more second curbs; and update a map layer to include the output at the road portion.

8. The non-transitory computer-readable storage medium of claim 7, wherein the sensor data indicate a height level of eyes of the first driver within the first vehicle with respect to a ground level.

9. The non-transitory computer-readable storage medium of claim 7, wherein the vehicle attribute data indicate a vehicle type, a vehicle height, a wheel width, a wheel height, a vehicle seat height, a thickness between a floor surface of a vehicle cabin and an exterior vehicle surface opposing the floor surface, one or more ranges of motion of the vehicle seat, or a combination thereof.

10. The non-transitory computer-readable storage medium of claim 7, wherein the map data indicate one or more road curvatures of the road portion, one or more turn restrictions the road portion, a number of lanes for the road portion, one or more lane directions for the road portion, a functional class for the road portion, a speed limit for the road portion, one or more physical dividers within the road portion, dimensions of the first curb, a curvature of the curb, a relative position of the first curb with respect to one or more road objects within the road portion, or a combination thereof.

11. The non-transitory computer-readable storage medium of claim 9, wherein the one or more road objects is one or more road surface markings, one or more traffic lights, or a combination thereof.

12. The non-transitory computer-readable storage medium of claim 7, wherein the sensor data indicate one or more first images acquired by one or more exterior facing cameras equipped by the vehicle, one or more second images acquired by one or more interior facing cameras equipped by the vehicle, radar or ultrasonic data indicating proximity of physical objects with respect to one or more proximity sensors equipped by the vehicle, steering wheel angles of the vehicle, wheel angels of the vehicle, a number of brake activations executed by the vehicle, acceleration data acquired by one or more accelerometers equipped by the vehicle, vehicle seat adjustment settings associated with the vehicle, side view mirror settings associated with the vehicle, or a combination thereof.

13. The non-transitory computer-readable storage medium of claim 7, wherein the computer program code instructions, when executed by at least one processor, cause the at least one processor to, responsive to the likelihood satisfying a threshold level, cause a notification on a user interface associated with the first driver, wherein the notification indicates: (i) a presence of the first curb; (ii) a path of travel for avoiding collision with the first curb; (iii) the likelihood; or (iv) a combination thereof.

14. The non-transitory computer-readable storage medium of claim 7, wherein the computer program code instructions, when executed by at least one processor, cause the at least one processor to, responsive to the likelihood satisfying a threshold level, cause an augmented reality head-up display of the first vehicle to display an image notifying the first curb on a windshield of the first vehicle.

15. A method of providing a map layer, the method comprising:

receiving vehicle attribute data associated with a first vehicle, map data indicating one or more attributes of a road portion including a first curb, and sensor data indicating an orientation of a first driver within the first vehicle;

causing a machine learning model to render a datapoint as a function of the vehicle attribute data, the map data, and the sensor data, wherein the datapoint indicates a likelihood of which the first driver will not be able to see the first curb when the first driver is maneuvering the first vehicle, and wherein the machine learning model is trained to predict the output based on historical data indicating events in which second drivers maneuvered second vehicles to encounter the first curb or one or more second curbs; and updating the map layer to include the datapoint at the road portion.

16. The method of claim 15, wherein the map layer includes one or more other datapoints indicating one or more other likelihoods of which the first driver will not be able to see the one or more second curbs, one or more third curbs, or a combination thereof at one or more other road portions when the first driver is maneuvering the first vehicle.

17. The method of claim 15, wherein the sensor data indicate a height level of eyes of the first driver within the first vehicle with respect to a ground level.

18. The method of claim 15, wherein the vehicle attribute data indicate a vehicle type, a vehicle height, a wheel width, a wheel height, a vehicle seat height, a thickness between a floor surface of a vehicle cabin and an exterior vehicle surface opposing the floor surface, one or more ranges of motion of the vehicle seat, or a combination thereof.

19. The method of claim 15, wherein the map data indicate one or more road curvatures of the road portion, one or more turn restrictions the road portion, a number of lanes for the road portion, one or more lane directions for the road portion, a functional class for the road portion, a speed limit for the road portion, one or more physical dividers within the road portion, dimensions of the first curb, a curvature of the curb, one or more relative positions of the first curb with respect to one or more road objects within the road portion, or a combination thereof.

20. The method of claim 15, further comprising causing a user interface to display the map layer, wherein the user interface is a mobile device, a display device of an infotainment system of the first vehicle, or a combination thereof.

* * * * *